US009428851B2

(12) United States Patent
Masuda et al.

(10) Patent No.: US 9,428,851 B2
(45) Date of Patent: Aug. 30, 2016

(54) COMPOSITE FIBER

(75) Inventors: Masato Masuda, Mishima (JP); Joji Funakoshi, Otsu (JP); Akira Kishiro, Mishima (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 14/126,245

(22) PCT Filed: Jun. 12, 2012

(86) PCT No.: PCT/JP2012/065014

§ 371 (c)(1),
(2), (4) Date: Dec. 13, 2013

(87) PCT Pub. No.: WO2012/173116

PCT Pub. Date: Dec. 20, 2012

(65) Prior Publication Data

US 2014/0120336 A1 May 1, 2014

(30) Foreign Application Priority Data

Jun. 15, 2011 (JP) ..... 2011-133562

(51) Int. Cl.

*D01F 11/08* (2006.01)
*D01F 8/04* (2006.01)
*D01D 5/36* (2006.01)

(52) U.S. Cl.

CPC ..... *D01F 11/08* (2013.01); *D01D 5/36* (2013.01); *D01F 8/04* (2013.01); *Y10T 428/249921* (2015.04); *Y10T 428/2929* (2015.01); *Y10T 428/2931* (2015.01)

(58) Field of Classification Search

CPC ... D10B 2331/04; D06N 3/0004; D02J 1/22; D04H 1/42; D04H 1/541; D04H 13/00; D01H 13/40; D01H 13/24; D03D 15/00; Y10T 442/64; Y10T 442/609; Y10T 428/2924; Y10T 442/431; Y10T 428/2929; Y10T 428/2931; Y10T 428/29; Y10T 442/3089; Y10T 428/24603; Y10T 428/24438; Y10T 428/24479; Y10T 428/24612; Y10T 428/23986; Y10S 428/904; Y10S 428/903

USPC ..... 428/221, 373, 374, 401, 370, 93, 364, 428/375, 365, 397, 363, 172, 151, 156, 171, 428/903, 904, 96, 399; 264/115, 172.13, 264/172.15, 172.17, 172.18, 176.1; 385/115, 123, 147, 127, 131; 528/308.1, 323, 308.6, 373, 271; 442/164, 189, 201

See application file for complete search history.

(56) References Cited

U.S. PATENT DOCUMENTS

| | | | | |
|---|---|---|---|---|
| 5,525,282 | A | 6/1996 | Dugan | |
| 7,622,188 | B2 * | 11/2009 | Kamiyama et al. | 428/370 |
| 2009/0042031 | A1 * | 2/2009 | Goda et al. | 428/401 |
| 2009/0275979 | A1 * | 11/2009 | Im et al. | 606/228 |
| 2010/0007042 | A1 | 1/2010 | Simmonds | |

FOREIGN PATENT DOCUMENTS

| | | | |
|---|---|---|---|
| EP | 2578640 | A2 * | 4/2013 |
| JP | 07-26420 | | 1/1995 |

(Continued)

OTHER PUBLICATIONS

Merriam-Webster Online Dictionary, Adjacent Definition, www.merriam-webster.com/dictionary/adjacent.html. Mar. 15, 2016. pp. 1-2.*

*Primary Examiner* — Hai Vo
(74) *Attorney, Agent, or Firm* — DLA Piper LLP (US)

(57) ABSTRACT

The fiber cross-section of an island-in-a-sea composite fiber perpendicular to the fiber axis, the island component and sea component are arranged such that the sea component surrounds the island components. The composite cross-section is very consistent, and the fiber has excellent post-processibility. The island-in-a-sea composite fiber wherein diameter of the island component is 10 to 1000 nm, variation of the island component diameter is 1.0 to 20.0%, modification ratio is 1.00 to 1.10, and variation of the modification ratio is 1.0 to 10.0%.

7 Claims, 6 Drawing Sheets

(56) References Cited

FOREIGN PATENT DOCUMENTS

| | | | |
|---|---|---|---|
| JP | 08-158144 | | 6/1996 |
| JP | 08158144 A | * | 6/1996 |
| JP | 2007-039858 | | 2/2007 |
| JP | 2007-100243 | | 4/2007 |
| WO | WO 0242529 A1 | * | 5/2002 |
| WO | 2005/095686 | | 10/2005 |
| WO | 2011/093331 | | 8/2011 |

* cited by examiner

Fig.3 of Kamiyama

Figure 6
(a)
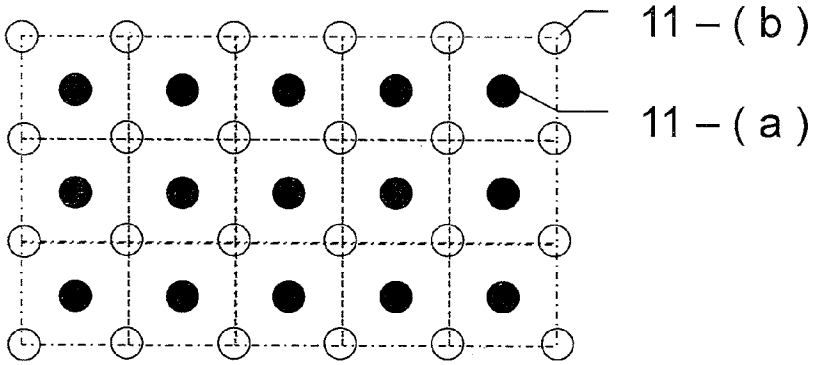
(b)
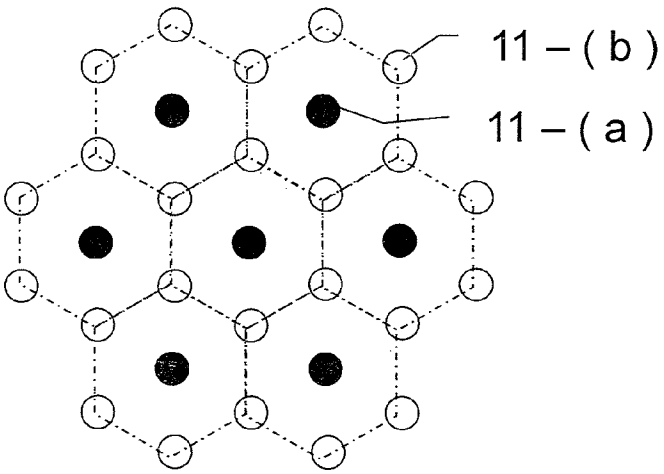

COMPOSITE FIBER

TECHNICAL FIELD

This disclosure relates to an island-in-a-sea composite fiber comprising 2 or more types of polymers wherein, in the fiber cross section perpendicular to the fiber axis, the island component and sea component are arranged such that the sea component surrounds the island components. More specifically, this disclosure relates to an island-in-a-sea composite fiber wherein cross-sectional morphology of the island component is perfect circle, and the morphology is highly consistent.

BACKGROUND ART

Fibers prepared by using a thermoplastic polymer such as polyester or polyamide have excellent dynamic properties and size stability. Accordingly, these fibers are widely used not only in clothing applications, but also in automobile interior applications as well as industrial applications, and their industrial values are very high. However, the properties required for these fibers have diversified with the diversification of the textile applications, and existing polymers are often incapable of responding to these requirements. In such situations, designing a new fiber from scratch, namely, from the molecular level is associated with cost and time problems, and development of a composite fiber having the properties of two or more polymers is often selected. In such composite fibers, properties including sensory effects such as texture and bulkiness and mechanical properties such as tensile strength, initial modulus, and abrasion resistance that can not be realized by the single use of the main ingredient can be realized, for example, by coating the main ingredient with another ingredient. Various composite fibers with varying morphologies have been suggested, and various technologies have been proposed depending on the intended application of the fiber. Of these composite fibers, technical development is active in the field of so called "island-in-a-sea composite fibers" which are fibers having many island components arranged in the sea component.

Typical use of the island-in-a-sea composite fiber is the use as ultrafine fibers. In this case, the island-in-a-sea composite fiber is generally produced by arranging the island components comprising a hardly soluble component in the sea component comprising an easily soluble component, and removing the easily soluble component from the fiber or from the textile product prepared from the fiber to thereby produce an ultrafine fiber comprising the island component. In these days, ultimately thin ultrafine fiber of nano order level that can not be realized by the spinning of a single fiber can be prepared by using this technique, and the ultrafine fiber as thin as several hundred nm exhibits soft texture and flexibility that can never be realized by ordinary fibers. By using such properties, these ultrafine fibers have been developed, for example, as artificial leathers and textiles having new textures. Other applications include high density fabrics prepared by utilizing fiber interval compactness, and these high density fabrics are used, for example, in sport gear requiring wind protection and water repellency. The ultrafine fibers are capable of entering into minute grooves, and increasing the specific surface area, and dirt is caught in the fine gaps between the fibers. Accordingly, this fabric has high absorption and dust collecting ability. In the applications of industrial material, this property is used for wiping cloth and precision polishing cloth of precision machines.

The island-in-a-sea composite fibers which may be used for the production of the ultrafine fibers are generally divided into two types of fibers. One is polymer alloy type fibers produced by melt-kneading the polymers, and the other is those produced by composite spinning by using a composite nozzle. Of these composite fibers, those produced by the composite spinning are excellent since accurate control of the cross section of the composite fibers is enabled.

Various techniques are disclosed for the composite spinning of the island-in-a-sea composite fibers. Exemplary such techniques include those using a composite nozzle such as Japanese Patent Application Laid-Open No. H8-158144 (Claims) and Japanese Patent Application Laid-Open No. 2007-39858 (pages 1 and 2).

In Japanese Patent Application Laid-Open No. H8-158144 (Claims), a reservoir of the polymer (easily soluble component) with dilated cross section is provided under the hole of the hardly soluble component, and a core-sheath composite flow is thereby formed by inserting the hardly soluble component in the easily soluble component. After combining a plurality of such core-sheath composite flows, the combined flow is drawn and ejected to the final hole. In this technique, pressure of both the hardly soluble component and the easily soluble component are controlled by the size of the flow path between the flow dividing flow path and the introductory hole to thereby realize consistent pressure at the entrance of the introductory hole. The amount of the polymer ejected from the introductory hole is thereby regulated. Such a manner of controlling the pressure of the introductory holes to the same pressure is a good method in view of controlling the polymer flow. However, if the size of the island component is to be finally reduced to the level of nano order, the polymer flow rate should be reduced to the level as low as $10^{-2}$ g/min/hole to $10^{-3}$ g/min/hole at least for the sea component side introductory hole. In this case, the pressure loss which is in proportional relationship to the polymer flow rate and the wall interval becomes substantially zero, and accurate control of the sea component and island component polymers is very difficult. As a matter of fact, the ultrafine fibers generated from the island-in-a-sea composite fiber produced in the Examples is approximately 0.07 to 0.08 d (about 2700 nm), and the ultrafine fiber of nano order level is not yet obtained.

Japanese Patent Application Laid-Open No. 2007-39858 (pages 1 and 2) discloses that an island-in-a-sea composite fiber having fine hardly soluble components arranged in the cross section of the composite fiber is produced by repeating drawing and combining the composite flow wherein the easily soluble components and the hardly soluble components are arranged at a relatively equal interval. In this approach, the island component may be regularly arranged in the inner layer portion of the cross section of the island-in-a-sea composite fiber. However, shear force is applied to the outer layer portion by the nozzle wall during the drawing of the composite flow, and the flow rate is disturbed on the cross section being drawn. Large difference in the fiber diameter and morphology of the hardly soluble component is generated between the outer layer and the inner layer of the composite flow. In Japanese Patent Application Laid-Open No. 2007-39858 (pages 1 and 2), the procedure as described above has to be repeated over and over before the final ejection if the nano order level island component is to be produced. Accordingly, a large difference in the cross-sectional direction may be formed in the distribution of the morphology of the composite fiber, and this difference results in the variety of the diameter and the cross-sectional morphology of the island.

In the case of Japanese Patent Application Laid-Open No. 2007-100243 (pages 1 and 2), the nozzle technology used is the conventional known pipe-type island-in-a-sea composite nozzle. However, ratio of the melt viscosity between the easily soluble component and the hardly soluble component is defined to enable production of an island-in-a-sea composite fiber having a relatively controlled cross-sectional morphology. Japanese Patent Application Laid-Open No. 2007-100243 (pages 1 and 2), also describes that an ultrafine fiber having a consistent fiber diameter is produced by dissolving the easily soluble component in the post-processing step. In this approach, however, the hardly soluble component is finely divided by a group of pipes into minute flows, and these flows are supplied to core-sheath composite forming holes to produce core-sheath composite flows, and the composite flows are combined and drawn to form the island-in-a-sea composite fiber. The thus formed core-sheath composite flows of the number substantially corresponding to the number of islands are formed into a bundle, this bundle is drawn in an ejection plate having tapered holes formed therethrough to compress in the cross-sectional direction of the fiber for ejection from the ejection hole. In this stage, the fiber cross section is greatly compressed to $1/500$ to $1/3000$ and, accordingly, the core-sheath composite flows are compressed by interfering with each other. As a consequence, the cross section of the flow ejected from the composite forming hole attempts to become a perfect circle by the surface tension, while interference with other composite flows result in the deformed cross-sectional morphology of the island component and, therefore, intentional control of the island component is very difficult. Accordingly, consistency of the cross-sectional morphology was realized only to a limited extent. Such a limit is due to the principle of the conventional pipe-type nozzle that a bundle is formed by collecting the core-sheath composite flow that had been formed, and drawing the bundle, and only minimal effect can be expected to adjust the pipe configuration and arrangement. Accordingly, formation of a fiber having perfect circle cross section with consistent cross-sectional morphology was extremely difficult by using known approaches such as in Japanese Patent Application Laid-Open No. 2007-100243 (pages 1 and 2).

The island-in-a-sea composite fiber wherein 2 or more types of polymers are present in the cross section is inherently associated with the problem of unstable behavior in the deformation upon elongation of the fiber, and this instability is likely to be amplified when the island component has inconsistent cross-sectional morphology. The island-in-a-sea composite fiber did not have the stability of a common single fiber, and the conditions which can be used in the post-processing had been limited. When the sea is removed to generate the ultrafine fibers, the inconsistency and variety of the island component often invited partial deterioration of the island component both between the island components and along the fiber axis of the island components, and this often invited loss of the island component in the course of the post-processing step. This situation is not negligible in the island-in-a-sea composite fiber where the island component has achieved nano order level ultimate thinness since it greatly affects whether the fiber and the textile products produced therefrom can endure the post-processing step as well as their properties. In view of such a situation, there is a strong demand for the development of an island-in-a-sea composite fiber having an extremely thin island component with nano order diameter wherein the island component is a perfect circle and the cross-sectional morphology is consistent.

It could therefore be helpful to provide an island-in-a-sea composite fiber wherein the island component is an extremely thin fiber having a nano-order diameter, and the fiber has consistent morphology with perfect circle cross section.

SUMMARY

We thus provide:

(1) An island-in-a-sea composite fiber wherein diameter of the island component is 10 to 1000 nm, variation of the island component diameter is 1.0 to 20.0%, modification ratio is 1.00 to 1.10, and variation of the modification ratio is 1.0 to 10.0%.

(2) An island-in-a-sea composite fiber according to (1) wherein variation of the diameter of the sea component surrounded by the 3 adjacent island components is 1.0 to 20.0%.

(3) An island-in-a-sea composite fiber according to (1) or (2) wherein variation of the distance between 2 adjacent island components is 1.0 to 20.0%.

(4) An ultrafine fiber produced by removing the sea component from the island-in-a-sea composite fiber of any one of (1) to (3).

(5) A textile product wherein the island-in-a-sea composite fiber of any one of (1) to (4) or the ultrafine fiber of (4) constitutes at least a part of the product.

The island-in-a-sea composite fiber is a fiber wherein the sea component is ultimately thin with the nano-order diameter while the cross section is a perfect circle, and the diameter and the cross-sectional morphology of the island component is consistent.

The island-in-a-sea composite fiber is primarily characterized by the very consistent diameter and cross-sectional morphology of the nano-order island component. As a consequence, equal tension is applied to all island components at the cross section of the fiber when a tension is applied, and this enables control of the stress distribution at the fiber cross section. This also means reduced incidence of the breakage of the composite fiber and the ultrafine fiber in the fiber forming step including the spinning step and the drawing step, the post-processing steps, the weaving/knitting step, and the sea removing step when a relatively high tension is applied. Production of a textile product at a high productivity is thereby enabled. The fact that the solvent acts equally to every island components in the sea removal is also very favorable because designing the conditions used in the sea removal becomes simple, and partial breakage, loss, and other troubles of the island component (ultrafine fiber) by the solvent is suppressed. This characteristic feature of the island-in-a-sea composite fiber is particularly advantageous since even slight variation of the diameter and morphology of the island component severely affects the influence given to the island component when the fiber has a nano order diameter. In addition, morphology of the island components in the island-in-a-sea composite fiber is a perfect circle, and the morphology of the cross section of the island-in-a-sea composite fiber is consistent. Accordingly, when the sea is removed to generate the ultrafine fibers, fine and consistent gaps are formed between the ultrafine fibers and such gaps will be distributed throughout the bundle. Accordingly, excellent water absorption and rapid distribution of the absorbed water is realized in the textile product comprising the ultrafine fiber by the capillary action of the gap.

BRIEF DESCRIPTION OF THE DRAWINGS

FIG. 3(*a*) is a front cross sectional view of the main section of the composite nozzle. FIG. 3(*b*) is a transverse cross sectional view of a part of the distribution plate. FIG. 3(*c*) is a cross sectional view of the ejection plate.

FIG. 6 shows examples of the arrangement of the distribution holes in the final distribution plate.

EXPLANATION OF NUMERALS

Figure 1:
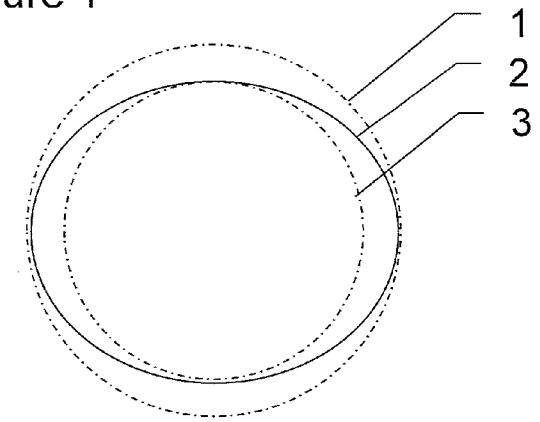
FIG. 1 is a schematic view of the island component of the island-in-a-sea composite fiber according to one example.

1 circumscribed circle of the island component
2 island component
3 inscribed circle of the island component
4 straight line
4-(*a*) straight line 1 connecting the centers of the island components
4-(*b*) straight line 2 connecting the centers of the island components
4-(*c*) straight line 3 intersecting the straight lines connecting the centers of the island components
5 inscribed circle between the island components
6 measuring plate
7 distribution plate
8 ejection plate
9 measuring hole
9-(*a*) measuring hole 1
9-(*b*) measuring hole 2
10 distribution groove
10-(*a*) distribution groove 1
10-(*b*) distribution groove 2
11 distribution hole
11-(*a*) distribution hole 1
11-(*b*) distribution hole 2
12 ejection introductory hole
13 drawing hole
14 ejection hole
15 annular groove
16 an example of the island components of the island-in-a-sea composite fiber

DETAILED DESCRIPTION

Next, our fibers and methods are described in detail by referring to preferred examples.

The island-in-a-sea composite fiber is a fiber wherein two or more types of polymers respectively form their cross sections in a direction perpendicular to the longitudinal axis. The composite fiber has a cross-sectional structure wherein the island component comprising a particular polymer is scattered in the sea component comprising the other polymer.

As the first and second requirements, the island-in-a-sea composite fiber should have a diameter of the island component of 10 to 1000 nm and a variation of the island component diameter of 1.0 to 20.0%.

The diameter of the island component and the variation of the island component diameter are calculated as described below.

A multifilament comprising the island-in-a-sea composite fibers is embedded in an embedding medium such as epoxy resin, and pictures of the cross section are taken by a transmission electron microscope (TEM) so that 150 or more island components can be observed. When 150 or more island components can not be observed in the cross section of single composite fiber, a picture of cross sections of considerable number of composite fibers is taken so that 150 or more island components in total could be confirmed. If desired, the contour of the island component may be highlighted by metal staining. The diameter of the 150 island components randomly selected in the pictures of the fiber cross section is measured. The "diameter of the island component" is the diameter of the perfect circle circumscribing the cross section of the fiber perpendicular to the fiber axis in the two dimensional pictures. In FIG. 1, an exemplary deformed island component is shown for clarity and, the diameter of the perfect circle (1 in FIG. 1) circumscribing the island component (2 in FIG. 1) at the largest number of (2 or more) points is the "diameter of the island component." The value of the island component diameter is measured in "nm" unit to the first decimal place, and rounding to the decimal. The term "variation of the island component diameter" used herein is the value calculated from the evaluation results of the island component diameter by the following equation:

Variation of the island component diameter (CV (%) of the island component diameter)=(standard deviation of the island component diameter/average of the island component diameter)×100 (%), and rounding the value at the second decimal place. The procedure as described above was repeated for similarly taken 10 pictures, and the simple number average of the evaluation of the 10 pictures was used as the "island component diameter" and the "variation of the island component diameter."

In the island-in-a-sea composite fiber, the island component diameter can be reduced to less than 10 nm. However, use of the diameter of 10 nm or more enables prevention of the partial breakage of the island component in the fiber production and, also, prevention of the fiber breakage in the post-processing step. In addition, the conditions used in the processing may also be readily selected when ultrafine fibers are prepared from the island-in-a-sea composite fiber. On the other hand, the island component should have a diameter of up to 1000 nm when the pliability, water absorption, and wiping performance of the ultrafine fiber bundles which are among the characteristic features that are to be realized.

The diameter of the island component in the island-in-a-sea composite fiber should be adequately selected to 10 to 1000 nm according to the conditions used in the processing and the intended application. However, the diameter of the island component is preferably 10 to 700 nm to foreground the characters such as pliability, water absorption, and wiping performance owing to the nano order fiber diameter. The diameter of the island component is more preferably 100 to 700 nm in consideration of completing the post-processing step, ease of selecting the conditions in the sea removal treatment, and handling convenience of the resulting textile product.

The variation of the diameter of the island component should be 1.0 to 20.0%, and this range means absence of local presence of coarse island components. Hence, control of the distribution of the stress in the subsequent post-processing step to facilitates completion of such step. The variation in such range is particularly meaningful for completion of the drawing step, weaving step, and sea removal step conducted under higher tension. The ultrafine fibers obtained after the sea removal will also have consistent quality. In view of the situation as described above, smaller variation of the island component diameter is desirable, and the variation of the island component diameter is preferably 0.0 to 15.0%. The variation of the island component diameter is more preferably 1.0 to 7.0% when the intended use includes high performance sport gears or precision polishing in the IT field where high precision is required.

The island-in-a-sea composite fiber has the island component with the perfect circle cross-sectional morphology. In other words, the island component has the modification ratio of 1.00 to 1.10, and the variety of the modification ratio of as low as 1.0 to 10.0%. These are the third and the fourth important requirements of the island-in-a-sea composite fiber.

The term "modification ratio" used herein is the value determined by the same method as the diameter of the island component and the variation of the island component diameter as described above. More specifically, the modification ratio is a value determined by taking two dimensional pictures of the cross section of the island-in-a-sea composite fiber, depicting perfect circle inscribing the cross section (contour) of the island component in the picture at the largest number of (2 or more) points as shown by the dot-and-dash line in FIG. 1 (3 in FIG. 1) as the inscribing circle to thereby use the diameter of the perfect circle as the diameter of the inscribing circle, calculating the modification ratio by the following equation:

Modification ratio=(diameter of the island component/diameter of the inscribed circle) to the third decimal place, and rounding at the third decimal place. This modification ratio is measured for randomly selected 150 island components. When 150 or more island components can not be observed in the cross section of single composite fiber, a picture of cross sections of considerable number of composite fibers is taken so that 150 or more island components in total can be confirmed. The term "variation of the modification ratio" used herein is the value calculated from the average and standard deviation of the modification ratio by the following equation:

Variation of the modification ratio (CV, %)=(standard deviation of the modification ratio/average of the modification ratio)×100(%), and rounding the value at the second decimal place. The procedure as described above was repeated for similarly taken 10 pictures, and the simple number average of the evaluation of the 10 pictures was used as the "modification ratio" and the "variation of the modification ratio."

The modification ratio is an index which will be 1.10 or less when the cross section of the island component is substantially perfect circle. In the island-in-a-sea composite fiber prepared by spinning with the conventional known island-in-a-sea composite nozzle, the modification ratio is sometimes 1.10 or less. However, the island-in-a-sea composite fiber is deformed in the entire cross section, and in particular, the modification ratio of the area around the outermost layer is often 1.20 or higher. Variation of the modification ratio also increases in such island-in-a-sea composite fiber, and the island-in-a-sea composite fiber does not satisfy our requirements. Such case is also associated with the increase in the variation of the island component diameter and such island-in-a-sea composite is even less likely to meet the requirements of the present invention.

Our island-in-a-sea composite fibers are such that the cross section of the nano order island component is substantially a perfect circle, and that each island component has substantially the same cross-sectional morphology. In other words, it is important that the modification ratio of the island component is 1.00 to 1.10.

When the island component has an modification ratio of 1.00 to 1.10 and, accordingly, when the cross section of the island component is substantially a perfect circle, the ultrafine fibers produced from the island-in-a-sea composite fiber will contact the tangential line of the circles. Therefore, gaps corresponding to the fiber diameter will be formed between the single fibers in the fiber bundle, and when a textile product is prepared by using the ultrafine fibers, the product will exhibit excellent water absorption due to the capillary phenomenon and, also, excellent dust catching ability and wiping performance. In addition, the island component in the island-in-a-sea composite fiber has a nano order diameter, and the gaps formed between the resulting ultrafine fibers are very minute, and many gaps are distributed over the textile product. Accordingly, the absorbed water diffuses at a high speed, and the textile product may be used, for example, for a highly functional and comfortable inner wear with high perspiration absorbing property. In the application where the fabric is brought in direct contact with human skin as in the case of the high performance inner wear, the soft texture realized by the nano order fiber diameter contributes to a comfortable feel in addition to the water absorption property. In the meanwhile, the nano order gaps may also contribute to improving impregnation and retention of drugs and the like, and effects of the highly functional drug can be maintained for a long time and, accordingly, the fiber is also well adapted for use in cosmetic applications.

In the island-in-a-sea composite fiber, it is also important that the modification ratio of the island components, namely, variation in the morphology of the island components is small because two or more types of polymers are present on the cross section of the fiber, and behavior of the fiber is unstable upon elongation. When the cross-sectional morphology is consistent, stress will be evenly applied to the cross section of the island-in-a-sea composite fiber in the fiber production step and the post-processing step. In other words, spinning speed can be increased in the fiber production step, and high stress can be used (high degree elongation) in the drawing step, and production of the product exhibiting high mechanical properties at high productivity is thereby enabled. In addition, troubles such as breakage of fibers and fabrics can be prevented in the post-processing step. Furthermore, low morphological variation also facilitates completion of the post-processing step without generating partly deteriorated parts between the island components or in the fiber axis direction of the island component in the sea removal and loss of mechanical properties and fiber breakage of excessively deteriorated parts. Low morphological variation is also preferable since loss of ultrafine fibers in the post-processing can be prevented.

In view of the situation as described above, it is important that the variation of the modification ratio of the island component is 1.0 to 10.0%, and that the morphology of the island component is consistent.

When ultrafine fibers of nano order are generated, quite many ultrafine fibers will be present on the surface of the textile product. When the cross-sectional morphology of the ultrafine fiber is inconsistent, texture and wiping performance of the resulting textile product will be uneven. In addition, the ultrafine fibers which are excessively processed in the sea removal are deteriorated, and these fibers are easily cut by abrasion or the like inducing unnecessary fluffiness. In view of the consistency of the surface performance of the textile product prepared from such ultrafine fiber, variation of the modification ratio is more preferably 1.0 to 7.0%. When the usage intended is high performance sports gear or precision polishing in the IT field where particularly high consistency and durability are required, preferable range of the variation of the modification ratio is 1.0 to 5.0%.

As described above, the island-in-a-sea composite fiber has excellent consistency of the cross-sectional morphology, and the fiber is also excellent in fiber formation capability such as spinnability and stretchability and the fiber will endure the post-processing process. In addition, the ultrafine fiber will not be unnecessarily deteriorated in the post-processing process such as the sea removal, the bundle of the ultrafine fiber will have excellent mechanical properties. In considering the sea removal, consistency of the sea component should also be taken into consideration in addition to the consistency of the island component. In view of the situation as described above, variation of the diameter of the sea component surrounded by the 3 adjacent island components in the island-in-a-sea composite cross section is preferably 1.0 to 20.0%.

The term "variation of the sea component diameter" used herein is the value determined by a procedure similar to the diameter of the island component and the variation of the island component diameter as described above. More specifically, the variation of the sea component diameter is a value determined by taking two dimensional pictures of the cross section of the island-in-a-sea composite fiber, depicting a perfect circle inscribing 3 adjacent island components (2 in FIG. 2) in the picture as shown 5 in FIG. 2 and using the diameter of this perfect circle as the diameter of the sea component, measuring this sea component diameter for randomly selected 150 sea components, and calculating the variation of the sea component diameter (CV (%) of the sea component diameter) from the average and the standard deviation of the sea component diameter. When 150 or more sea components can not be observed in the cross section of single composite fiber, the diameter may be evaluated at 150 or more sea components in total from considerable number of the composite fibers. The term "variation of the sea component diameter" is the value calculated by the following equation:

Variation of the sea component diameter=(standard deviation of the sea component diameter/average of the sea component diameter)×100(%), and rounding the value at the second decimal place. As in the case of the evaluations of the cross-sectional morphology, the evaluation procedure was repeated for 10 pictures, and the simple number average of the evaluation of the 10 pictures was used as the "variation of the sea component diameter."

To improve the consistency of the resulting ultrafine fiber, the variation of the sea component diameter is preferably smaller and, more preferably, 1.0 to 10.0%.

In the removal of the sea, the sea component surrounded by the island components may remain between the island components as a residue. This residue may adhere to the adjacent sea components, and the resulting ultrafine fibers may form bundles after the drying, and the ultrafine fibers in the form of bundles may lose various merits inherent to the ultrafine fibers of the nano order fiber diameter. Accordingly, the island-in-a-sea composite fiber preferably has the ratio of the sea component diameter to the island component diameter of 0.01 to 1.00.

The term "sea component diameter" is the diameter of the perfect circle (5 in FIG. 2) inscribing 3 adjacent island components which is measured in the course of determining the variation of the sea component diameter as described above. More specifically, the sea component diameter is determined by measuring the sea component diameter for randomly selected 150 sea components in "nm" unit to the first decimal place in the pictures similarly taken as the pictures used in the evaluation of the island component diameter, rounding this value to the decimal place, and calculating the average. When 150 or more sea components can not be observed in the cross section of single composite fiber, the sea component diameter ratio may be evaluated at 150 or more sea components in total from considerable number of the composite fibers. The term "sea component diameter ratio" is the value calculated by dividing the diameter of the sea component diameter by the diameter of the island component, and rounding the value at the third decimal place. This evaluation procedure was repeated for 10 similarly taken pictures, and the simple average was used as the "sea component diameter ratio."

In the island-in-a-sea composite fiber, this sea component diameter ratio can be reduced to the level of less than 0.01. However, this means that the interval between the island components is very small, and in view of suppressing partial contact between islands (island fusion) in the case of the fiber having high island density, this ratio is preferably at least 0.01. The sea component diameter ratio of up to 1.00 means that sea component is adequately present between the island component, and the sea removal can be effected at high efficiency since retention of the residue of the sea component between the island components is suppressed. As a consequence, the resulting ultrafine fiber enjoys good fiber openness as well as excellent texture. In view of the situation as described above, in the island-in-a-sea composite fiber, the sea component diameter ratio is preferably 0.01 to 1.00, and more preferably 0.01 to 0.50 in consideration of the improvement in the productivity by the increase of the island ratio. In consideration of the ease of designing the nozzle and process precision of the nozzle production, the sea island component ratio is most preferably 0.10 to 0.50.

As described above, the island-in-a-sea composite fiber has very consistent structure in the cross-sectional morphology, and the island component is arranged in very regular manner. In such point of view, the arrangement can be defined by the distance between the island components, and the variety of the distance between 2 adjacent island components is preferably 1.0 to 20.0%. The distance between the island components means the distance between the centers of the 2 adjacent island components as shown by 4 in FIG. 2, and the center of the island component is the center of the circumscribed circle of the island component (1 in FIG. 1) as described above. This distance between the island components is determined by the method similar to the evaluation of the island component diameter as described above, and the two dimensional pictures of the cross section of the island-in-a-sea composite fiber are taken, and the distance between the island components is measured for 150 randomly selected locations. When 150 or more island components can not be observed in the cross section of single composite fiber, a picture of cross sections of a plurality of composite fibers may be taken so that 150 or more island components in total could be evaluated. This variation in the distance between the island components was calculated from the average and the standard deviation of the distance between the island components by the equation:

Variation of the distance between the island components (CV (%) of the distance between the island components)=(standard deviation of the distance between the island components/average of the distance between the island components)×100(%), and the value was rounded to the decimal place. This value was evaluated for the 10 pictures taken by the same procedure, and the simple number average for the 10 pictures was used as the variation in the distance between the island components.

When the variation in the distance between the island components is 1.0 to 20.0%, the island component is regularly arranged in the cross section of the island-in-a-sea composite fiber. Accordingly, such composite fiber can be used as a high performance composite fiber provided with mechanical properties. In addition, the island-in-a-sea composite fiber has the nano order level island component and sea component and, therefore, refractive index and reflectance of the light entering from the side surface and cross-sectional surface of the fiber can be controlled when these components are within the range as described above. Considering such optical control, smaller variation in the distance between the island components is preferable, and variation in the distance between the island components is more preferably 1.0 to 10.0% in such point of view. When such control is utilized, the composite fiber may be provided with optical effects such as color tone, and when the island component and the sea component are properly arranged, the composite fiber may also be provided with wavelength selection ability for the light transmitting therethrough and the light reflected therefrom.

Figure 2:
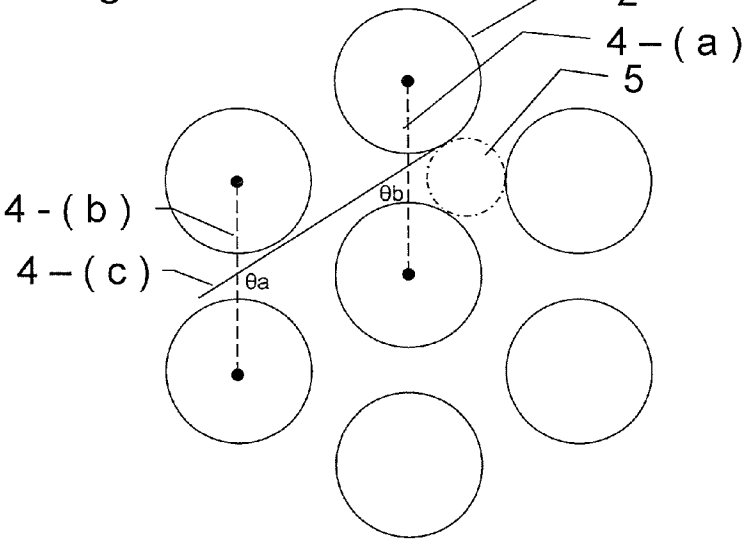
FIG. 2 is a schematic view of the cross section of the island-in-a-sea composite fiber.

To improve the mechanical properties and the optical properties of the composite fiber, regular and compact arrangement of the island component is preferable and, as shown in FIG. 2, it is preferable that the straight lines each connecting the centers of the 2 adjacent island components ((4-(*a*) (straight line 1 connecting the centers of the island components) and 4-(*b*) (straight line 2 connecting the centers of the island components) in FIG. 2) in the 4 adjacent island components are in parallel relation with each other. The term "parallel relation" used herein is defined such that, when straight line 3 (4-(*c*) in FIG. 2) intersecting with 4-(*a*) and 4-(*b*) are depicted in FIG. 2, the sum of the interior angles (θa and θb in FIG. 2) is 175° to 185°. Evaluation of the parallel relation of the island component may be conducted by a procedure similar to the evaluation of the diameter of the island component and the variation of the island component diameter, namely, by taking pictures of the island-in-a-sea composite fiber, randomly selecting 100 locations, measuring the sum of the θa and the θb to the first decimal place as described above, and rounding the average to the decimal place. When the value was 175° to 185°, the fibers were determined to satisfy the parallel relation. When 100 or more island component arrangement (interior angle) can not be evaluated in the cross section of single composite fiber, 100 locations in total of the island component arrangement (interior angle) may be evaluated for the cross sections of a considerable number of composite fibers. This procedure was repeated for the similarly taken 10 pictures to complete the evaluation.

Such regular arrangement of the island component enables even bearing of the tension applied to the composite fiber in the fiber formation and post-processing by the cross section of the composite fiber. The fiber formation capability and the post-processibility are thereby greatly improved. More specifically, while spinning at a high spinning speed is generally difficult in the case of the island-in-a-sea composite fiber, spinning of the island-in-a-sea composite fiber can be conducted at a spinning speed without any trouble. The quality is also improved because the tension is not partially concentrated. Such regular arrangement of the island component also contributes to improvement of the efficiency of the sea removal. More specifically, the sea removal proceeds from the periphery of the island-in-a-sea composite fiber to the interior layer and, if the surrounding island components are in parallel relations, difference in the time required for the sea removal (the time required for the completion of the sea removal) will be caused, and the sea component between the island components will be always exposed to the solvent and efficient dissolution and discharge of the island component will be facilitated. The sea removal is thereby promoted, and the time required for the sea removal will be reduced.

The island-in-a-sea composite fiber preferably has a tensile strength of 0.5 to 10.0 cN/dtex and a tensile elongation 5 to 700%. The term "tensile strength" used herein is the value obtained by depicting the load—elongation curve for the multifilament under the conditions described in JIS L1013 (1999), and dividing the load at break by the initial fineness, and the tensile elongation is the value obtained by dividing the elongation at break by the initial length. Initial fineness is the value calculated from the measured fiber diameter, filament number, and density, or the weight per 10000 m calculated from simple average of repeatedly measured weight of the unit length of the fiber. The tensile strength of the island-in-a-sea composite fiber is at least 0.5 cN/dtex in view of completing the post-processing step and enduring the actual use. Practical upper limit is 10.0 cN/dtex. The tensile elongation is preferably at least 5% and the practical upper limit is 700% in consideration of completing the post-processing step. The tensile strength and the tensile elongation can be adjusted by controlling the conditions used in the production step according to the intended application.

When the ultrafine fibers prepared from the island-in-a-sea composite fiber is used for the purpose of general garments such as inner and outer wears, the tensile strength is preferably 1.0 to 4.0 cN/dtex, and the tensile elongation is preferably 20 to 40%. When the ultrafine fibers are used for sport gear used under severer conditions, the tensile strength is preferably 3.0 to 5.0 cN/dtex, and the tensile elongation is 10 to 40%. Exemplary non-garment applications include use of the ultrafine fiber for wiping cloth or polishing cloth. In these applications, the textile product wipes while being pulled by load. Accordingly, the tensile strength is preferably at least 1.0 cN/dtex, and the tensile elongation is preferably at least 10%. The mechanical properties within such range enable prevention of the cutting and loss of the ultrafine fibers during, for example, the wiping.

The island-in-a-sea composite fiber can be prepared into various intermediates such as wound package, tow, cut fiber, wadding, fiber ball, chord, pile, woven or knitted fabric, and nonwoven fabric and, then, the sea may be removed to form ultrafine fibers to thereby produce various textile products. Alternatively, the island-in-a-sea composite fiber may also be used as a textile product without any treatment, after partial removal of the sea component, or after removing the islands. The so-called textile product may be used for general garments such as jacket, skirt, trousers, and underwear, sport gear, garment materials, interior commodities such as carpet, sofa, and curtain, automobile interior products such as car sheet, home applications such as cosmetics, cosmetic masks, wiping cloth, and health product, environmental and industrial materials such as polishing cloth, filter, products for removal of toxic substance, and separator for battery, and medical applications such as suture, scaffold, artificial blood vessel, and blood filter.

Next, an example of the production method of the island-in-a-sea composite fiber is described in detail.

The island-in-a-sea composite fiber can be produced by forming an island-in-a-sea composite fiber comprising 2 or more polymers. Formation of the island-in-a-sea composite fiber is preferably conducted by island-in-a-sea composite spinning by melt spinning to increase productivity. The island-in-a-sea composite fiber, of course, can be produced also by solution spinning and the like. However, use of an island-in-a-sea composite nozzle is preferable in the spinning of the island-in-a-sea composite spinning to improve control of the fiber diameter and the cross-sectional morphology.

The island-in-a-sea composite fiber may also be produced with a conventional known pipe-type island-in-a-sea composite nozzle. However, control of the cross-sectional morphology of the island component using the pipe-type island-in-a-sea composite nozzle should be associated with the extreme difficulty of designing the nozzle and making the nozzle itself since production of the island-in-a-sea composite requires control of the polymer flow of the order of $10^{-1}$ g/min/hole to $10^{-5}$ g/min/hole which is several orders lower than the conditions used in the conventional art. Accordingly, the method using the island-in-a-sea composite nozzle as shown in FIG. 3 is preferable.

Figure 3:
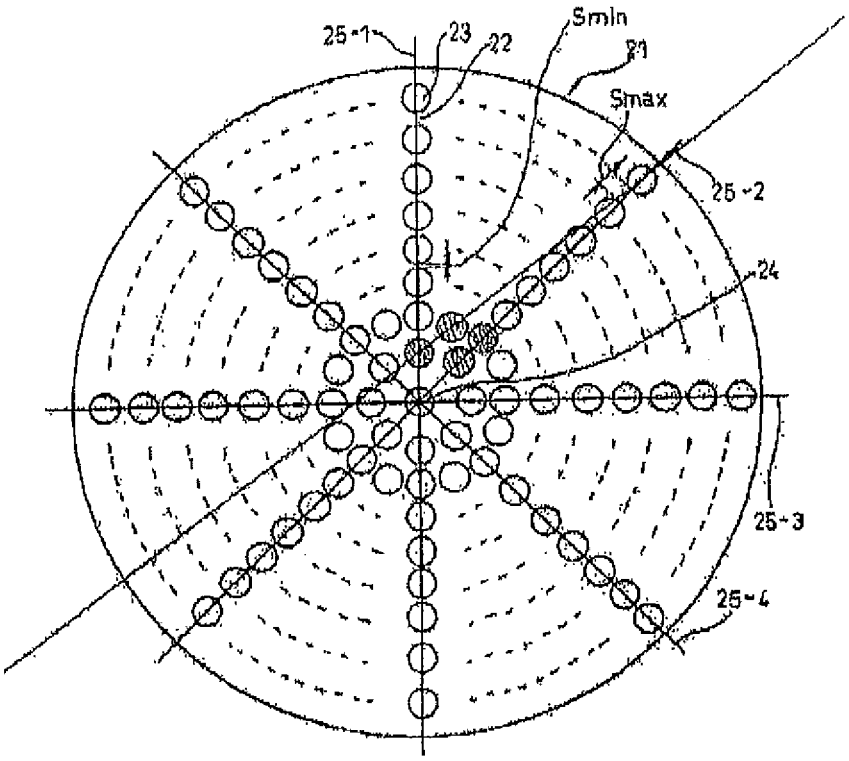
FIG. 3 consists of views explaining the production method of the ultrafine fiber and, more specifically, an example of the composite nozzle.

In the composite nozzle shown in FIG. 3, 3 main members, namely, a measuring plate 6, a distribution plate 7, and an ejection plate 8 are disposed in this order from the top, and these three members are accommodated in the spinning pack to be used in the spinning FIG. 3 is an example using 2 types of polymers, namely, polymer A (island component) and polymer B (sea component). When the island-in-a-sea composite fiber is produced for the production of ultrafine fibers by removing the sea, the island component may be prepared from a hardly soluble component and the sea component may be prepared from an easily soluble component. If desired, the spinning may be conducted by using three or more polymers including a polymer other than the hardly soluble component and the easily soluble component as described above. When two easily soluble components with different dissolution speeds to the solvent are used, and the island component comprising the hardly soluble component is surrounded by the easily soluble component having slower dissolution speed, and the remaining sea is formed from the easily soluble component having faster dissolution speed, the easily soluble component having slower dissolution speed functions as the protective layer of the island component, and the effect of the solvent during the sea removal is thereby suppressed. When a hardly soluble component having different properties is used, properties which can not be obtained by the ultrafine fiber comprising the single polymer can be preliminarily provided with the island component. Realization of such composite fiber technology using three or more polymers is difficult, particularly by using the conventional pipe-type composite nozzle. Accordingly, use of the composite nozzle utilizing the fine flow path as shown in FIG. 3 is preferable.

In the nozzle member shown in FIG. 3, the measuring plate 6 introduces the polymers by measuring the polymer amount corresponding to the ejection hole 14 or the polymer amount corresponding to the distribution hole of the sea and island component. Next, the island-in-a-sea composite cross section and the cross-sectional morphology in the cross section of the single (island-in-a-sea composite) fiber is controlled by the distribution plate 7. Finally, the composite polymer flow formed in the distribution plate 7 is compressed and ejected by the ejection plate 8. While no drawing is presented for simplicity of the explanation of the composite nozzle, the member disposed on the measuring plate may be the one formed with the flow path in accordance with the spinning machine and the spinning pack. Ready-made spinning pack and its members can be utilized if the measuring plate is designed to fit with the ready-made flow path member. Accordingly, a special spinning machine only adapted for use with the composite nozzle is not necessary. In addition, two or more flow path plates (not shown) are preferably disposed between the flow path and the measuring plates or between the measuring plate 6 and the distribution plate 7 so that a flow path enabling efficient transfer of the polymer in the cross-sectional direction of the nozzle and in the cross-sectional direction of the single fiber is provided for introduction to the distribution plate 7. The composite polymer flow ejected by the ejection plate 8 is cooled for solidification, applied with an oil agent, and taken up by the roller at the predetermined peripheral speed for the production of the island-in-a-sea composite fiber.

An example of the composite nozzle used in the present invention is described in detail by referring to FIGS. 3 to 6.

Figure 4:
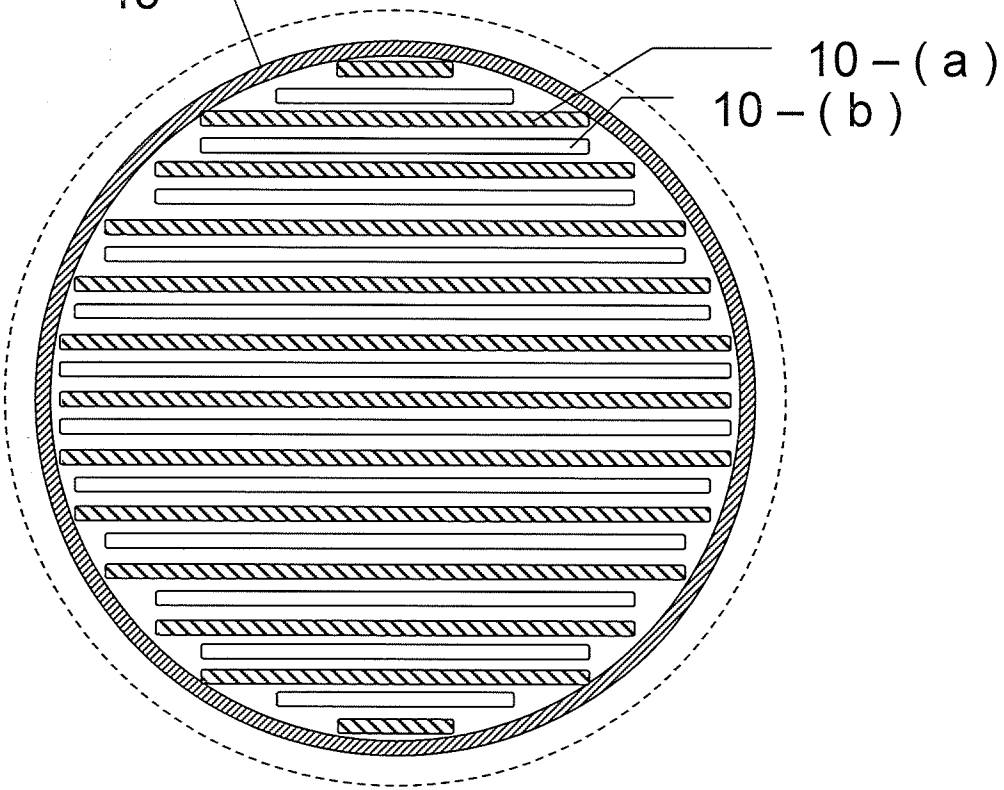
FIG. 4 shows a part of the distribution plate according to an example.
Figure 5:
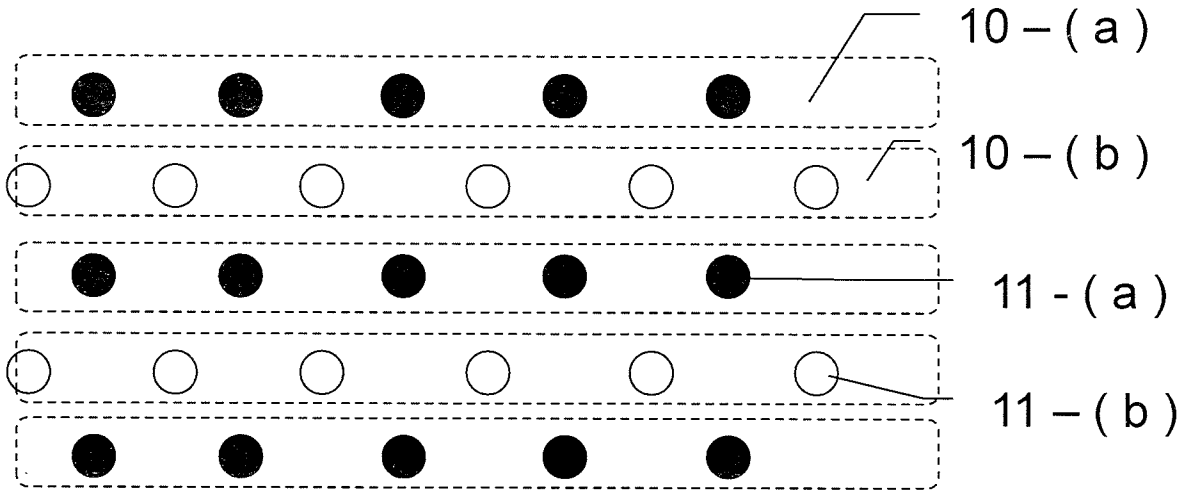
FIG. 5 is an example of the arrangement of the distribution grooves and distribution holes in the distribution plate.

FIGS. 3(*a*) to 3(*c*) are views that schematically explain an example of an island-in-a-sea composite nozzle. FIG. 3(*a*) is a front cross sectional view the main section of the island-in-a-sea composite nozzle. FIG. 3(*b*) is a transverse cross sectional view of a part of the distribution plate. FIG. 3(*c*) is a transverse cross sectional view of a part of the ejection plate. FIG. 4 is a plan view of the distribution plate. FIGS. 5, 6(*a*), and 6(*b*) are enlarged views of a part of the distribution plate. FIGS. 3 to 6 show groove and holes associated with one ejection hole.

Next, the composite nozzle shown in FIG. 3 is explained from the upstream to the downstream of the composite nozzle along the polymer flow. More specifically, the polymer flows through the measuring plate and the distribution plate and becomes a composite polymer flow, and the composite polymer flow is ejected from the ejection holes of the ejection plate.

Polymer A and polymer B flows into the spinning pack from its upstream. More specifically, the polymers A and B respectively flow into measuring hole for polymer A (9-(*a*) (measuring hole 1)) and measuring hole for polymer B (9-(*b*), (measuring hole 2)) of the measuring plate, and after being measured by the drawing hole provided in the lower surface of the measuring plate, the polymers A and B are introduced in the distribution plate 7. The polymer A and the polymer B are respectively measured by the pressure loss by the drawing in the measuring hole. The drawing is designed so that the pressure loss is at least 0.1 MPa and, on the other hand, so that the pressure loss is up to 30.0 MPa to thereby prevent deformation of the member due to the excessive pressure loss. The pressure loss is determined by the amount of polymer introduced into the measuring hole and the viscosity of the polymer. For example, when melt spinning is conducted at the spinning temperature of 280 to 290° C. and through-put rate per measuring hole of 0.1 to 5.0 g/min by using a polymer exhibiting a melt viscosity of 100 to 200 Pa s at the temperature of 280° C. and the strain rate of 1000 $s^{-1}$, ejection with adequate measuring can be conducted when the drawing of the measuring hole is such that the hole diameter is 0.01 to 1.00 mm, the L/D (ejection hole length/ejection hole diameter) is 0.1 to 5.0. When the melt viscosity of the polymer is lower than the viscosity range as described above, or the through-put rate of each hole is reduced, the hole diameter may be reduced toward the lower limit of the range as described above, and/or the hole length may be increased toward the upper limit of the range as described above. On the other hand, when the viscosity is high or the through-put rate is increased, the hole diameter and the hole length may be adjusted in a reverse way. Preferably, two or more measuring plate 6 may be laminated to incrementally measure the amount of polymer. More preferably, measuring plate is provided with the measuring holes in 2 to 10 stages. Such division of the measuring plate or the measuring hole into two or more stages is preferable for the control of the minimal polymer flow rate on the order of $10^{-1}$ g/min/hole to $10^{-5}$ g/min/hole which is smaller than the conditions used in the conventional art by several orders. However, the measuring plate is preferably divided into 2 to 5 stages in view of preventing excessive increase of the pressure loss per spinning pack, and reducing the risk of increase in the residence time or abnormal retention.

The polymer ejected from the measuring holes 9 (9-(*a*) and 9-(*b*) ) is introduced in the distribution groove 10 of the distribution plate 7. The grooves of the same number as the measuring hole 9 are provided between the measuring plate 6 and the distribution plate 7, and the flow path is provided so that the groove length is gradually elongated in the cross-sectional direction along the flow because dilatation of the polymer A and the polymer B in the cross-sectional direction before flowing into the distribution plate is preferable to increase stability of the island-in-a-sea composite cross section. As described above, it is also preferable to provide the measuring hole in each flow path.

The distribution plate is provided therethrough with the distribution grooves 10 (10-(*a*) (distribution groove 1) and 10-(*b*) (distribution groove 2)) for combining the polymer from the measuring holes 9, and also, with the distribution holes 11 (11-(*a*) (distribution hole 1) and 11-(*b*) (distribution hole 2)) for allowing the polymer to the downstream on the lower side of the distribution groove. The distribution groove 10 is preferably provided with at least 2 distribution holes therethrough. In addition, use of two or more distribution plates 7 is preferable to allow repeated combination and distribution of each polymer at least in some part of the distribution plates 7. When the flow path is designed as a repetition of "a plurality of distribution holes—the distribution groove—a plurality of distribution holes", the polymer can flow into other distribution holes even if some distribution holes are clogged since the polymer which was supposed to have passed through clogged distribution hole is substituted by the distribution groove in the downstream. In addition, when 2 or more distribution holes are provided under the distribution groove and this structure is repeated, the influence of the change of the flow path of the polymer from the clogged distribution hole to another distribution hole is reduced to negligible level. Another important merit of the provision of such distribution groove is combining the polymer from different flow paths, namely, the polymer with different thermal hysteresis, and variation in the viscosity is thereby suppressed. When such repetition of the "distribution holes—distribution groove—distribution holes" is designed, the distribution groove in the downstream may be arranged at a circumferential angle of 1 to 179° in relation to the upstream distribution groove to promote mixing of the polymer from different distribution grooves. This structure is favorable since the polymer which has undergone different thermal hysteresis can be remixed two or more times, and this structure is effective in controlling the island-in-a-sea composite cross section. In view of the intension of providing such mechanism, this mechanism of polymer flow combination and distribution should be provided from the most upstream part, and provision of such mechanism in the measuring plate or members in the further upstream is preferable. The "distribution hole" as used herein is preferably provided so that 2 or more such distribution holes are provided per distribution groove to thereby facilitate efficient division of the polymer. With regard to the distribution groove immediately before the ejection hole, provision of 2 to 4 distribution holes per distribution groove is preferable in view of the ease of designing the nozzle and control of the minute polymer flow rate.

As described above, the composite nozzle having such structure realizes constantly stable polymer flow, and production of the high precision island-in-a-sea composite fiber having extremely large number of islands is thereby enabled. Theoretically, the number of the distribution holes 11-(*a*) of the polymer A (number of islands) is 2 to infinite number as long as the space is admitted, while the practically possible range is 2 to 10000 islands. The more reasonable range for the island-in-a-sea composite fiber is 100 to 10000 islands. In terms of island packing density, 0.1 to 20.0 islands/mm2 is preferable. The "island packing density" is the number of islands per unit area, and larger value of the "island packing density" means the possibility of producing the island-in-a-sea composite fiber having a large number of islands. More specifically, the "island packing density" is the value determined by dividing the number of islands ejected from one ejection hole by the area of the ejection introductory hole. The island packing density can be changed for each ejection hole.

The cross-sectional morphology of the composite fiber and the cross-sectional morphology of the island component can be controlled by the arrangement of the distribution holes 11 for the polymer A and the polymer B in the distribution plate 7 immediately above the ejection plate 8. More specifically, the distribution holes for the polymer A 11-(*a*) and the distribution holes for the polymer B 11-(*b*) are preferably arranged in the so called houndstooth lattice arrangement wherein distribution holes of both types are alternately arranged. For example, the distribution grooves for the polymer A and the polymer B (10-(*a*) and 10-(*b*) ) may be alternately arranged in the cross-sectional direction, and the distribution holes for the polymer B may be provided between the distribution holes for the polymer A at a regular interval as shown in FIG. 4, so that the polymer A and the polymer B are arranged in square lattice as shown in FIG. 6(*a*). When 2 distribution grooves for the polymer B are provided between the distribution grooves for the polymer A, and more specifically, when the distribution holes are provided such that polymer sequence is BBABB in the cross sectional direction (in vertical direction in FIG. 6), the polymer A and the polymer B will be arranged in hexagonal lattice as shown in FIG. 6(*b*). The arrangement of the distribution holes is not limited to the polygonal lattice arrangements as described above, and other arrangements include circumferential provision of the distribution hole for the sea component surrounding the distribution hole for the island component. The arrangement of the distribution holes is preferably determined in relation to the combination of the polymers as described below. In consideration of the wide variety of the polymer combination, the distribution hole arrangement is preferably a polygonal lattice arrangement, and more specifically, at least quadrilateral lattice. In the composite nozzle as described above, it is preferable for the production of the island-in-a-sea composite fiber that both of the polymer A and the polymer B are present as dots, namely, that the sea component is directly arranged as dots in the island-in-a-sea composite cross section since the island-in-a-sea composite cross section constituted in the distribution plate is analogously compressed and ejected from the nozzle. When the arrangement is as shown in FIG. 6, the amount of the polymer ejected from each type of distribution holes in the amount of the polymer per ejection hole will be the share in the island-in-a-sea composite cross section. The distribution area of the polymer A is limited to the area indicted in FIG. 6 by the dotted line.

To realize the cross-sectional morphology of the island-in-a-sea composite fiber, the melt viscosity ratio of the polymer A to the polymer B (polymer A/polymer B) is preferably adjusted to 0.9 to 10.0 in addition to the arrangement of the distribution hole as described above. More specifically, while the distribution range of the island component is basically controlled by the arrangement of the distribution, the polymer flows are brought in contact with each other and subjected to size reduction in the cross-sectional direction by the drawing hole 13 of the ejection plate, and the melt viscosity ratio of the polymer A to the polymer B, namely, the rigidity ratio after melting affects formation of the cross section. Therefore, the melt viscosity ratio of the polymer A to the polymer B is more preferably 1.1 to 10.0. The term "melt viscosity" used herein is the value measured by reducing moisture content of polymer chips to 200 ppm or less in a vacuum desiccators, and measuring the melt viscosity in a melt viscometer capable of conducting the measurement by incrementally changing the strain rate in nitrogen atmosphere. The melt viscosity was measured at the same temperature as the temperature used in the spinning, and the melt viscosity at the strain rate of 1216 $s^{-1}$ was regarded the melt viscosity of the particular polymer. The melt viscosity ratio is the value determined by separately measuring the melt viscosity of relevant polymers, calculating the viscosity ratio of polymer A to polymer B, and rounding the resulting value at the second decimal place.

The composite polymer flow constituted from the polymer A and the polymer B ejected from the distribution plate flows into the ejection plate 8 from the ejection introductory hole 12. Provision of the ejection introductory holes 12 in the ejection plate 8 is preferable. The ejection introductory hole 12 is a hole provided to facilitate the composite polymer flow ejected from the distribution plate 7 to flow in the direction perpendicular to the ejection surface for a predetermined length, and the ejection introductory hole 12 is provided to moderate difference of the flow rate between the polymer A and the polymer B and, also, to reduce flow rate distribution in the cross-sectional direction of the composite polymer flow. With regard to this reduction of the flow rate distribution, the flow rate of the polymer itself is preferably controlled by the through-put rate and the diameter and number of the holes of the distribution holes 11 (11-(*a*) and 11-(*b*) ). However, such full control by the nozzle design may result, for example, in the limitation of the number of islands and, accordingly, the ejection introductory hole of $10^{-1}$ to 10 seconds (length of the ejection introductory hole/polymer flow rate) before entering of the composite polymer flow in the drawing hole 13 is preferably designed to complete the relief of the flow rate ratio despite the existence of the need to consider the molecule weight of the polymers. When the ejection introductory hole within such range is provided, distribution of the flow rate is sufficiently relieved, and this contributes for the improvement in the stability of the cross section.

Next, the composite polymer flow is thinned in the cross-sectional direction as the composite polymer flows down the drawing hole 13 before being introduced in the ejection hole of the desired diameter. In this stage, while the streamline of the intermediate layers of the composite polymer flow is substantially straight line, curvature of the streamline is much higher in the outer layer. To obtain the island-in-a-sea composite fiber, the polymer is preferably drawn while retaining the cross-sectional morphology of the composite polymer flow comprising the numerous number of polymer flows of the polymer A and the polymer B. Accordingly, the drawing hole is preferably designed so that its wall is at an angle of 30° to 90° in relation to the ejection surface.

To retain the cross-sectional morphology in the drawing hole, the distribution plate immediately above the ejection plate is preferably provided with an annular groove 15 having the distribution holes formed at its bottom as shown in FIG. 4. The composite polymer flow ejected from the distribution plate is dramatically thinned in cross-sectional direction by the drawing hole with no mechanical restriction and, in the course of this thinning, flow of the outer layer of the composite polymer flow is significantly curved and the outer layer will also be subject to the shearing force applied by the wall of the drawing hole. In the region near the wall of the drawing hole, namely, in the outer layer of the polymer flow, the polymer in contact with the wall flows at a lower flow speed due to the shear stress, while the polymer flows at a higher speed in the interior and, in short, there is a slope in the flow rate distribution. Accordingly, provision of the annular groove 15 and the distribution holes 11 for the polymer B in the distribution plate 7 immediately above the ejection plate 8 is preferable since provision of such annular groove 15 and the distribution holes enables formation of the polymer B layer as the outermost layer of the composite polymer flow, which can be dissolved in the subsequent step. In other words, the shear stress generated between the polymer flow and the wall will be applied to the polymer B layer and, as a consequence, the flow rate distribution in the outer layer portion will be consistent in the circumferential direction, thereby contributing to the stability of the composite polymer flow. A dramatic improvement in the consistency of the fiber diameter and fiber morphology of the polymer A (island component) after the production of the composite fiber is thereby realized. The distribution holes in the bottom surface of the annular groove 15 may be provided by considering the number of distribution groove(s) formed in the distribution plate as well as the through-put rate. The distribution holes are typically formed at an interval in circumferential direction of 3°, and more preferably at 1°. To introduce the polymer to this annular groove 15, the distribution groove for one type of the polymer in the upstream distribution plate may be formed so that distribution holes are provided at opposite ends of the distribution groove extending in the cross-sectional direction. While the distribution plate of FIG. 4 has one annular groove, two or more annular grooves may be formed in the distribution plate, and different polymers may be introduced in the two or more annular grooves.

As described above, the composite polymer flow having the outer layer of polymer B is ejected to the spinning line by considering the length of the introductory hole and the angle of the wall of the drawing hole to thereby retain the cross-sectional morphology formed in the distribution plate. The ejection hole 14 is provided for the purpose of re-measuring the amount of the composite polymer flow, namely, through-put rate, and controlling the draft (spinning speed/ejection linear velocity). The diameter and length of the ejection hole 14 is preferably determined by taking the viscosity and the through-put rate of the polymer into consideration. In producing the island-in-a-sea composite fiber, the ejection hole diameter may be selected from 0.1 to 2.0 mm, and the L/D (length of the ejection hole/diameter of the ejection hole) may be selected from 0.1 to 5.0.

The island-in-a-sea composite fiber can be produced by using the composite nozzle as described above. It is to be noted that, when such composite nozzle is used, the island-in-a-sea composite fiber can also be produced by a spinning process using a solvent such as solution spinning In the case of melt spinning, exemplary polymers used for the island component and the sea component include those which can be used in the melt extrusion such as polyethylene terephthalate and its copolymer, polyethylene naphthalate, polybuthylene terephthalate, polytrimethylene terephthalate, polypropylene, polyolefin, polycarbonate, polyacrylate, polyamide, polylactic acid, and thermoplastic polyurethane. In view of the high melting point, the preferred are polycondensation polymers such as polyester and polyamide. The polymer may preferably have a melting point of 165° C. or higher in consideration of the heat resistance. The polymer may also contain an additive such as an inorganic substance such as titanium oxide, silica, or barium oxide, carbon black, a colorant such as a dye or a pigment, a flame retardant, a fluorescent brightening agent, an antioxidant, or a UV absorbent. In view of removing the sea or the island component, the polymer may be selected from melt extrudable, easily soluble polymers such as a polyester and its copolymers, polylactic acid, polyamide, polystyrene and its copolymers, polyethylene, polyvinyl alcohol. The easily soluble component is preferably a polymer which is easily soluble in an aqueous solvent, hot water, or the like such as copolymerization polyester, polylactic acid, and polyvinyl-alcohol, and the most preferred are polyethylene glycol, sodium sulfoisophthalate, and a polyester prepared by copolymerizing sodium sulfoisophthalate with another monomer, polylactic acid, and the like in view of the spinnability and ease of dissolution in a low-concentration aqueous solvent.

In combining the hardly soluble components and the easily soluble component from those as mentioned above, the hardly soluble component may be first selected according to the intended use, and the easily soluble component may be thereafter selected based on the melting point of the hardly soluble component so that the easily soluble component is spinnable at the same spinning temperature. To improve the consistency of the fiber diameter and cross-sectional morphology of the island component in the island-in-a-sea composite fiber, molecular weight and the like of each component is preferably adjusted by taking the melt viscosity ratio as described above into consideration. When ultrafine fibers are produced from the island-in-a-sea composite fiber, a larger difference between the dissolution speed of the hardly soluble component and the dissolution speed of the easily soluble component in the solvent used for the sea removal is preferable in view of the stability of the cross-sectional morphology and retention of the mechanical properties of the resulting ultrafine fibers. More specifically, the polymer combination may be adequately selected so that the difference will be somewhere up to approximately 3000. Exemplary polymer combinations for preparing the ultrafine fiber from the island-in-a-sea composite fiber include, in view of the melting point, use of polyethylene terephthalate having 1 to 10% by mole of 5-sodium sulfoisophthalate copolymerized therewith for the sea component and use of polyethylene terephthalate or polyethylene naphthalate for the island component, and use of polylactic acid for the sea component and nylon 6, polytrimethylene terephthalate, or polybuthylene terephthalate for the island component.

The temperature for spinning the island-in-a-sea composite fiber is a temperature at which the polymer having the higher melting polymer or the higher viscosity of the two or more polymers is flowable. The temperature at which the polymer starts to show the flowability differs by the molecular weight, and this temperature may be determined by using the melting point of the polymer as an index and, more specifically, this temperature may be a temperature not exceeding a temperature 60° C. higher than the melting point. The spinning at a temperature not exceeding such temperature is preferable since the polymer will not be thermally decomposed in the spinning head or spinning pack and the decrease in the molecular weight will be suppressed.

In the spinning of the island-in-a-sea composite fibers, the polymer is ejected at an through-put rate per ejection hole of 0.1 g/min/hole to 20.0 g/min/hole to stably eject the polymer. In determining the through-put rate, pressure loss at the ejection hole is preferably taken into consideration to thereby realize ejection stability. More specifically, the through-put rate which is typically determined by considering the pressure loss 0.1 MPa to 40 MPa is preferably determined in relation to melt viscosity of the polymer, diameter of the ejection hole diameter, length of the ejection hole, and the like.

The ratio of the hardly soluble component to the easily soluble component in the spinning of the island-in-a-sea composite fibers may be selected based on the through-put rate so that the sea/island ratio is 5/95 to 95/5. With regard to the sea/island ratio, increase of the island ratio is preferable in view of increasing the productivity of the ultrafine fiber. However to realize the long term stability of the island-in-a-sea composite cross section, the sea ratio is more preferably 10/90 to 50/50 to enable the production of the ultrafine fiber while retaining the stability. More preferably, the sea ratio is 10/90 to 30/70 to rapidly complete the sea removal and improve the openness of the ultrafine fiber.

The thus ejected island-in-a-sea composite polymer flow is cooled for solidification, applied with an oil agent, and taken up by a roller at the predetermined peripheral speed to thereby produce the island-in-a-sea composite fiber. The spinning speed may be determined in relation to the through-put rate and the desired fiber diameter, and the spinning speed is preferably 100 to 7000 m/min to stably produce the island-in-a-sea composite fiber. The island-in-a-sea composite fiber is preferably elongated (stretched) the orientation and improve the mechanical properties. This tensile elongation may be conducted after taking up the fiber in the spinning step, or directly after the spinning without taking up the fiber.

Figure 7:
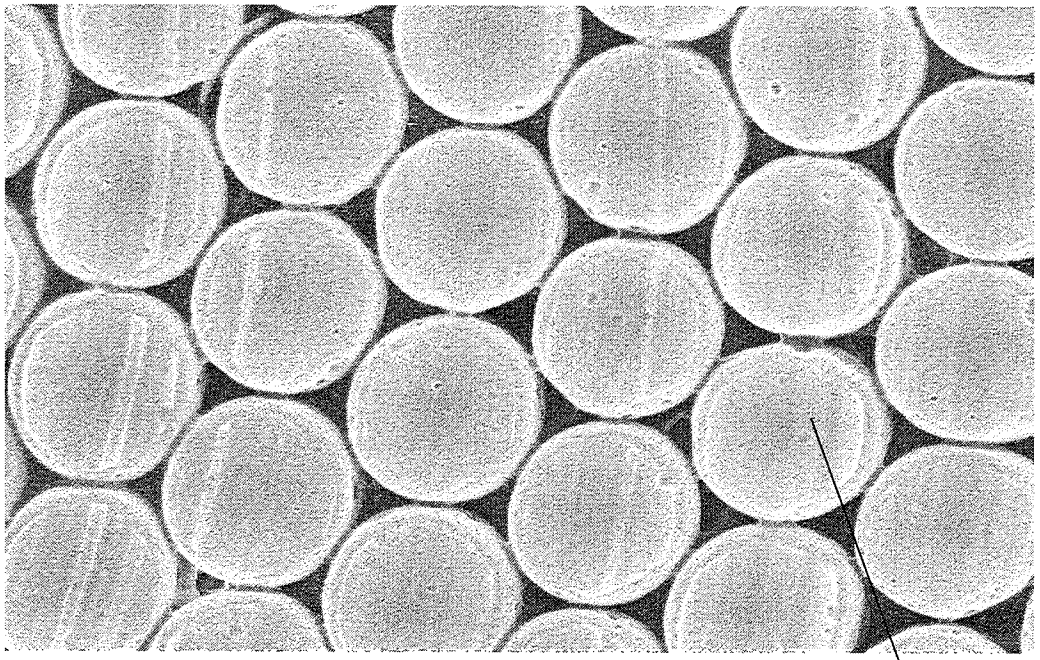
FIG. 7 shows an example of the cross section of the island-in-a-sea composite fiber.

The conditions used in the elongation are such that, for example, a fiber comprising a polymer having thermoplasticity capable of melt spinning is elongated in the axial direction of the fiber with no difficulty in a stretcher comprising one or more pairs of rollers according to the ratio of the peripheral speed of the first roller at a temperature not lower than the glass transition temperature and not higher than the melting point to the peripheral speed of the second roller at a temperature equivalent to the crystallization temperature, and the stretched fiber is thermally set and taken up, thereby producing the composite fiber having the cross section of the island-in-a-sea composite fiber as shown in FIG. 7. In the case of the polymer exhibiting no glass transition, dynamic viscoelasticity of the composite fiber (tan δ) is measured, and a temperature higher than the peak temperature on the higher temperature side of the thus obtained tan δ may be selected as the preliminary heating temperature. To increase the draw ratio and improve the mechanical properties, it is also preferable to incrementally conduct the drawing step.

To obtain the ultrafine fiber from the thus obtained island-in-a-sea composite fiber, the composite fiber is immersed in a solvent capable of dissolving the easily soluble component to thereby remove the easily soluble component and obtain the ultrafine fiber comprising the hardly soluble component. When the easily soluble component is a copolymerized PET such as the PET having 5-sodium sulfoisophthalate copolymerized therewith or polylactic acid (PLA), an alkaline aqueous solution such as aqueous sodium hydroxide may be used for the sea removal. The treatment of the composite fiber by the alkaline aqueous solution may be conducted, for example, by immersing the composite fiber or a textile structure prepared from the composite fiber in an alkaline aqueous solution. In this step, the alkaline aqueous solution is preferably heated to a temperature of 50° C. or more to promote the progress of the hydrolysis. Use of a fluid dying machine in the treatment is also preferable since a large amount of fiber or textile structure can be treated at once at a high productivity, and such high productivity is preferable in industrial point of view.

The production method of the ultrafine fiber has been described based on the commonly used melt spinning. Of course, the production may be conducted, for example, by melt blowing and spun bonding, and also, by wet and dry solution spinning.

EXAMPLES

Next, the ultrafine fiber is described in detail by referring to Examples.

Following evaluations were conducted for the Examples and Comparative Examples.

A. Melt Viscosity of the Polymer

The polymer in the form of chips was dried in a vacuum desiccators to a moisture content of 200 ppm or less, and the melt viscosity was measured by incrementally changing the strain rate by Capillograph 1B manufactured by Toyo Seiki Seisaku-sho, Ltd. The temperature used in the measurement was the same as the spinning temperature, and the melt viscosity at 1216 $s^{-1}$ was recorded in the Examples or the Comparative Examples. The measurement was started 5 minutes after introducing the sample in thermal furnace, and the measurement was conducted in a nitrogen atmosphere.

B. Fineness 100 m of the island-in-a-sea composite fiber was weighed, and multiplied by 100 to calculate the fineness. This procedure was repeated 10 times, and simple average of the measurements were calculated and rounded at the second decimal place for use as the fineness.

C. Mechanical Properties of the Fiber

Stress—strain curve of the island-in-a-sea composite fiber was measured by using a tensile tester (TENSILON model UCT-100 manufactured by Orientec Co., Ltd.) for the sample having a length of 20 cm under the condition of a tensile speed of 100%/min. Load at break was read, and the value was divided by the initial fineness to calculate tensile strength. Strain at break was also read, and this value was divided by the sample length and multiplied by 100 to calculate drawing at break. For each type of value, the procedure was repeated 5 times for each level, and simple average of the measurements were calculated and rounded at the second decimal place.

D. Diameter of the Island Component and Variation of the Island Component Diameter (CV, %)

The island-in-a-sea composite fiber was embedded in epoxy resin, frozen by FC-4E cryosectioning system manufactured by Reichert, sectioned by Reichert-Nissei ultracut N (ultramicrotome) equipped with a diamond knife. Picture of the section surface was taken by using Model H-7100FA transmission electron microscope (TEM) manufactured by Hitachi at a magnitude capable of observing at least 150 island components. When 150 or more island components could not be observed in the cross section of single composite fiber, a picture of cross sections of a plurality of composite fibers was taken so that 150 or more island components in total could be confirmed. 150 island components were randomly selected from the picture, and island component diameter of all island components was measured by using image processing software (WINROOF) to calculate the average and the standard deviation. From these results, the fiber diameter (CV, %) was calculated by the following equation:

$$\text{Variation of the island component diameter (CV, \%)} = (\text{standard deviation}/\text{average}) \times 100.$$

The values were measured for all of the 10 pictures taken at 10 different locations, and the average of 10 locations was calculated. The values were measured by the unit of nm to the first decimal place, and rounded to the decimal place. The island component diameter and the variation of the island component diameter are represented by this "average."

E. Modification Ratio of the Island Component and Variation of the Modification Ratio (CV, %)

Pictures of the cross section of the island component were taken by repeating the measurement procedure of the island component diameter and the variation of the island component diameter and, in these pictures, diameter of the perfect circle which circumscribes the cross section at largest number of points (two or more points) was used for the island component diameter, and in addition, diameter of the perfect circle which inscribes the cross section at largest number of points (two or more points) was used for the diameter of the inscribed circle. The modification ratio was calculated by the following equation:

Modification ratio=(diameter of the island component/diameter of the inscribed circle) to the third decimal place, and rounded at the third decimal place. This modification ratio was measured for the randomly selected 150 island components, and the variation of the modification ratio (CV, %) was calculated from the average and the standard deviation by the following equation. When 150 or more island components could not be observed in the cross section of single composite fiber, a picture of cross sections of a plurality of composite fibers was taken so that 150 or more island components in total could be confirmed.

Variation of the modification ratio (CV, %)=(standard deviation of the modification ratio/average of the modification ratio)×100(%)

The variation of the modification ratio was measured for all of the 10 pictures taken at 10 different locations, and the average of 10 locations was calculated. The value was rounded at the second decimal place. The modification ratio and the variation of the modification ratio are represented by this "average."

F. Variation of the Sea Component Diameter and Sea Component Diameter Ratio

Pictures of the cross section of the island-in-a-sea composite fiber were taken by repeating the measurement procedure of the island component diameter and the variation of the island component diameter as described above. By using these pictures, the diameter of the perfect circle inscribing the nearest 3 island components (2 in FIG. 2) was used as shown by 5 in FIG. 2 for the "sea component diameter." This sea component diameters was measured for randomly selected 150 locations by using an image processing software (WINROOF), and the average and the standard deviation were calculated. The sea component diameter (CV, %) was calculated from these results by using the following equation. When 150 or more island components could not be observed in the cross section of single composite fiber, a picture of cross sections of two or more composite fibers was taken so that 150 or more island components in total could be confirmed.

Variation of the sea component diameter (CV, %)=(standard deviation/average)×100.

The evaluation was conducted for 10 pictures, and simple number average of the evaluation of these 10 pictures was rounded at the second decimal place, and used as the variation of the sea component diameter.

In addition, the sea component diameter was divided by the island component diameter, and the calculated value was rounded at the third decimal for use as the sea component diameter ratio. The sea component diameter and the sea component diameter ratio are represented by this "average."

G. Evaluation of Island Component Arrangement

When the center of the island component is the center of the circumscribed circle (1 in FIG. 1) of the island component, the distance between the island components is the value defined as the distance between the centers of the 2 adjacent island components as shown by 4 in FIG. 2. The evaluation is conducted by the method similar to the evaluation of the island component diameter as described above, and the two dimensional pictures of the cross section of the island-in-a-sea composite fiber are taken, and the distance between the island components is measured for 150 randomly selected locations. When 150 or more island components could not be observed in the cross section of single composite fiber, a picture of cross sections of a plurality of composite fibers was taken so that 150 or more island components in total could be evaluated.

This variation in the distance between the island components was calculated from the average and the standard deviation of the distance between the island components by the equation:

Variation of the distance between the island components (CV (%) of the distance between the island components)=(standard deviation of the distance between the island components/average of the distance between the island components)×100(%), and rounding to the decimal place. This value was evaluated for the 10 pictures taken by the same procedure, and the simple number average for the 10 pictures was used as the variation in the distance between the island components.

For the 100 randomly selected sets of 4 adjacent island components from the pictures taken, straight lines were drawn like 4-(*a*), 4-(*b*), and 4-(*c*) in FIG. 2 to measure the sum of θa and θb (FIG. 2) to the first decimal, and the average was calculated by rounding to the decimal. This evaluation procedure was repeated for all of the 10 pictures taken.

H. Evaluation of Loss of Ultrafine Fibers (Island Component) in the Sea Removal

Knitted fabrics of the island-in-a-sea composite fibers produced under various spinning conditions were placed in a sea removal bath (bath ratio, 100) filled with the solvent which dissolves the sea component to thereby dissolve and remove 99% or more of the sea component.

The evaluation as described below was conducted to confirm the loss of the ultrafine fiber.

100 ml of the solvent used in the sea removal was collected, and this solvent was filtered through a glass fiber filter paper (retention particle size, 0.5 μm). Loss of the ultrafine fiber was confirmed from the difference in the dry weight of the filter paper before and after the sea removal treatment. The loss of the ultrafine fiber was evaluated "D" (marked loss) when the weight difference was 10 mg or more, "C" (considerable loss) when the weight difference was less than 10 mg and at least 7 mg, "B" (slight loss) when the weight difference was less than 7 mg and at least 3 mg, and "A" (no loss) when the weight difference was less than 3 mg.

I. Opening of the Ultrafine Fiber

Knitted fabrics of the island-in-a-sea composite fiber was subjected to the sea removal treatment under the sea removal conditions as described above, and the picture of the cross section of the knitted fabric was taken by model VE-7800 scanning electron microscope (SEM) manufactured by Keyence at a magnification of 1000. Pictures of the cross section at 10 locations of the knitted fabric were taken, and the condition of the ultrafine fiber was observed from the pictures.

The fiber opening was evaluated "A" (excellent opening) when the ultrafine fibers were independent and isolated from each other, "B" (good opening) when the number of bundles per picture was less than 3, "C" (poor opening) when the number of bundles per picture was less than 6, and "D" (no opening) when the number of bundles per picture was 6 or more.

Example 1

The island component used was polyethylene terephthalate (PET1 having a melt viscosity of 160 Pa s), and the sea component was the PET copolymerized with 8.0% by mole of the 5-sodium sulfoisophthalate (copolymerized PET1 having a melt viscosity of 95 Pa s). These components were separately melted at 290° C., weighed, and introduced in a spin pack having our composite nozzle as shown in FIG. 2 incorporated therein to eject the composite polymer flow from the ejection holes. In the distribution plate immediately above the ejection plate, 1000 distribution holes were provided therethrough per ejection hole for the island component, and the hole arrangement pattern was as shown in FIG. 6(*b*). The annular groove for the sea component shown as 15 of FIG. 4 was the one having the distribution holes formed therethrough at an interval of 1° in the circumferential direction. The length of the ejection introductory hole was 5 mm, the drawing hole was formed at an angle of 60°, the ejection hole diameter was 0.5 mm, and the ejection hole length/ejection hole diameter was 1.5. The composite ratio of the sea/island components was 10/90, and after ejection and cooling for solidification, the composite polymer flow was provided with an oil agent and wound at a spinning speed of 1500 m/min to collect as-spun fiber of 150 dtex—15 filaments (total through-put rate, 22.5 g/min). The wound as-spun fiber was stretched 4 times between the roller which had been heated to 90° C. and 130° C. at an drawing speed of 800 m/min. The resulting island-in-a-sea composite fiber was 37.5 dtex—15 filaments. Our island-in-a-sea composite fiber has very consistent constitution of the cross section as described below, and it had high strechability that no spindle exhibited yarn breakage even when the sampling was conducted with 10 spindle stretcher for 4.5 hours.

The island-in-a-sea composite fiber had mechanical properties including the tensile strength of 4.4 cN/dtex and the tensile elongation of 35%.

When the cross section of the island-in-a-sea composite fiber was observed, the island component diameter was 450 nm, the variation of the island component diameter was 4.3%, the modification ratio was 1.02, the variation of the modification ratio was 3.9%, and the island component of nano order had a perfect circle cross section with very consistent morphology. With regard to the arrangement of the island component, the arrangement was parallel with the sum of the interior angle of 180° and highly accurate with the variation in the distance between the island components of 2.1%. The island-in-a-sea composite fiber collected in Example 1 was very consistent also for the sea component, and the sea component was arranged at the sea component diameter ratio of 0.12 and the variation of the sea component diameter of 5.0%.

The island-in-a-sea composite fiber collected in Example 1 was subjected to the sea removal treatment in a 1% by weight aqueous sodium hydroxide solution which had been heated to 75° C. As described above, the island-in-a-sea composite fiber of the Example 1 had consistent sea component constitution (low variation of the sea component) as well as even arrangement of the island component (low variation of the island component), and therefore, the sea removal proceeded efficiently even if the aqueous alkali solution was at a low concentration. Accordingly, the island component was not excessively damaged, and the sea removal was conducted with no loss of the ultrafine fiber (as demonstrated by the evaluation (A) of the ultrafine fiber loss). The sea component diameter ratio was also small (0.12), and the island component was arranged parallel, with the sea component fully discharged with no residue of the sea component remaining between the ultrafine fibers. As a consequence, openness of the ultrafine fiber was very favorable (as demonstrated by the evaluation of the openness). The results are shown in Table 1.

Examples 2 to 5

The procedure of Example 1 was repeated except that the composite ratio of the sea/island component was incrementally changed to 30/70 (Example 2), 50/50 (Example 3), 70/30 (Example 4), and 90/10 (Example 5). The evaluation results of the island-in-a-sea composite fibers are shown in Table 1. As in the case of Example 1, the island-in-a-sea composite fibers had excellent island component diameter, morphology, and sea component consistency. The island-in-a-sea composite fibers of Examples 2 to 5 had low variation of the sea component and low variation in the distance between the island components, and accordingly, reduced ultrafine fiber loss. The fiber openness of Example 2 was equivalent to that of Example 1 due to the parallel arrangement of the island component despite somewhat larger sea component diameter ratio of Example 2. The fiber openness of Examples 3 to 5 somewhat reduced with the increase in the sea component diameter ratio, while the fiber openness of these Examples was acceptable level.

TABLE 1

| | | | Example 1 | Example 2 | Example 3 | Example 4 | Example 5 |
|---|---|---|---|---|---|---|---|
| Polymer | Sea | — | Copolymerized PET1 | Copolymerized PET1 | Copolymerized PET1 | Copolymerized PET1 | Copolymerized PET1 |
| | Island | — | PET1 | PET1 | PET1 | PET1 | PET1 |
| Sea island ratio | Sea | % | 10 | 30 | 50 | 70 | 90 |
| | Island | % | 90 | 70 | 50 | 30 | 10 |
| Nozzle | Number of islands | Island/G | 1000 | 1000 | 1000 | 1000 | 1000 |
| | G number | — | 15 | 15 | 15 | 15 | 15 |
| Island-in-a-sea composite fiber | Fineness | dtex | 37.5 | 37.5 | 37.5 | 37.5 | 37.5 |
| | Tensile strength | cN/dtex | 4.4 | 3.5 | 2.5 | 2.3 | 2.1 |
| | Tensile elongation | % | 35 | 30 | 29 | 29 | 29 |
| Island component | Island component diameter | nm | 449 | 395 | 333 | 254 | 150 |
| | Variation of the island component diameter | % | 4.3 | 4.5 | 4.6 | 5.4 | 7.4 |
| | Modification ratio | — | 1.02 | 1.01 | 1.03 | 1.05 | 1.08 |
| | Variation of the modification ratio | % | 3.9 | 4.0 | 4.2 | 5.2 | 6.0 |
| | Variation of the distance between the island components | % | 2.1 | 2.5 | 3.0 | 4.3 | 5.6 |
| | Arrangement of the island components | ° | 180 | 180 | 179 | 179 | 180 |
| Sea component | Variation of the sea component diameter | % | 5.0 | 5.0 | 5.3 | 5.8 | 7.9 |
| | Sea component diameter ratio | — | 0.12 | 0.22 | 0.33 | 0.42 | 0.47 |
| Post-processibility | Loss of the ultrafine fiber | — | A | A | A | B | B |
| | Openness of the ultrafine fiber | — | A | A | B | B | C |
| Note | | | | | | | |

Examples 6 and 7

The procedure of Example 1 was repeated except that the spinning was conducted by using the distribution plate having 500 distribution holes (Example 6) and 300 distribution holes (Example 7) provided therethrough for the island component per ejection hole, and that the composite ratio of the sea/island components was 20/80. As demonstrated by the evaluation results of the island-in-a-sea composite fibers as shown in Table 2, the island component diameter was larger compared to Example 1 while the island-in-a-sea composite cross section had very consistent constitution. The island-in-a-sea composite fibers of the Examples 6 and 7 exhibited no fiber loss, and since the sea component ratio is small as in the case of Example 1, and the island component is in the parallel arrangement, the fiber openness was also favorable. The results are shown in Table 2.

Example 8

The procedure of Example 1 was repeated except that the spinning was conducted by using the distribution plate having 2000 distribution holes provided therethrough for the island component per ejection hole, and that the composite ratio of the sea/island components was 50/50. In spite of the very dense islands (2000 islands), this island-in-a-sea composite fiber had consistent cross section with no fusion between the islands. The results are shown in Table 2.

Examples 9 and 10

The procedure of Example 1 was repeated except that the spinning was conducted by using the distribution plate having the hole arrangement pattern of FIG. 6(*a*) and 3000 distribution holes provided therethrough for the island component per ejection hole, and that the composite ratio of the sea/island components was 50/50 (Example 9) and 85/15 (Example 10).

The island-in-a-sea composite fibers collected in Examples 9 and 10 had somewhat larger variation of the island component diameter compared to Example 1. However, these fibers had consistent island-in-a-sea composite cross section compared to the prior art fibers (Comparative Example 1 to 3). The results are shown in Table 2.

TABLE 2

| | | | Example 6 | Example 7 | Example 8 | Example 9 | Example 10 |
|---|---|---|---|---|---|---|---|
| Polymer | Sea | — | Copolymerized PET1 | Copolymerized PET1 | Copolymerized PET1 | Copolymerized PET1 | Copolymerized PET1 |
| | Island | — | PET1 | PET1 | PET1 | PET1 | PET1 |
| Sea island ratio | Sea | % | 20 | 20 | 50 | 50 | 85 |
| | Island | % | 80 | 80 | 50 | 50 | 15 |
| Nozzle | Number of islands | Island/G | 500 | 300 | 2000 | 3000 | 3000 |
| | G number | — | 15 | 15 | 15 | 15 | 15 |
| Island-in-a-sea composite fiber | Fineness | dtex | 37.5 | 37.5 | 37.5 | 37.5 | 39.5 |
| | Tensile strength | cN/dtex | 3.6 | 3.4 | 2.4 | 2.5 | 1.9 |
| | Tensile elongation | % | 30 | 30 | 26 | 28 | 21 |
| Island component | Island component diameter | nm | 740 | 960 | 240 | 195 | 110 |
| | Variation of the island component diameter | % | 3.9 | 1.8 | 7.0 | 10.0 | 15.1 |
| | Modification ratio | — | 1.02 | 1.03 | 1.05 | 1.07 | 1.08 |
| | Variation of the modification ratio | % | 2.1 | 1.9 | 4.9 | 6.2 | 7.2 |
| | Variation of the distance between the island components | % | 1.8 | 1.2 | 5.1 | 11.0 | 12.0 |
| | Arrangement of the island components | ° | 180 | 180 | 178 | 177 | 176 |
| Sea component | Variation of the sea component diameter | % | 3.9 | 1.9 | 5.5 | 10.5 | 12.0 |
| | Sea component diameter ratio | — | 0.18 | 0.18 | 0.36 | 0.36 | 0.46 |
| Post-processibility | Loss of the ultrafine fiber | — | A | A | B | B | B |
| | Openness of the ultrafine fiber | — | B | B | B | B | C |
| Note | | | | | | | |

Reference Examples 11 to 13

The sea component used was the PET copolymerized with 5.0% by mole of the 5-sodium sulfoisophthalate (copolymerized PET2 having a melt viscosity of 140 Pa s) and the distribution plate was the one having 150 distribution holes for the island component provided therethrough per ejection hole, and the ejection plate was the one having 110 ejection holes, and the spinning was conducted at a sea/island component composite ratio of 10/90 (Example 11), 30/70 (Example 12), and 90/10 (Example 13), and other conditions were the same as those used in the Example 1.

The island-in-a-sea composite fibers collected in Examples 11 to 13 were fibers of 50 dtex—110 filaments, and even though the composite fiber had low single fiber fineness, the cross section had consistent constitution, and the island component had parallel arrangement. Accordingly, the composite fiber exhibited good fiber formation capability (in the spinning and elongation) with no deformation in the elongation without defects. With regard to the post-processibility, the fiber loss was evaluated to be equivalent to that of Example 1, and the fiber openness was at an acceptable level although Example 13 exhibited somewhat inferior fiber openness with partial bundles. The results are shown in Table 3.

Reference Examples 14 to 16

The island component used was nylon 6 (N6 having a melt viscosity of 130 Pa s) and the sea component used was the copolymerized PET1 (having a melt viscosity of 150 Pa s) used in the Example 1. The distribution plate was the one having 500 distribution holes for the island component provided therethrough per ejection hole, and the ejection plate was the one having 100 ejection holes, and the spinning was conducted at a sea/island component composite ratio of 10/90 (Example 14), 30/70 (Example 15), and 90/10 (Example 16, a total through-put rate of 130 g/min, and a spinning temperature of 270° C. The draw ratio was 3.5, and other conditions were the same as those used in the Example 1.

The island-in-a-sea composite fibers collected in Examples 13 to 15 were fibers of 217 dtex—100 filaments, and even though the composite fiber had low single yarn fineness, spinning and drawing could be conducted with no trouble. The constitution and consistency of the cross section as well as processibility were equivalent to Example 1 even when N6 was used for the island component. The results are shown in Table 3.

TABLE 3

| | | | Reference Example 11 | Reference Example 12 | Reference Example 13 | Reference Example 14 | Reference Example 15 | Reference Example 16 |
|---|---|---|---|---|---|---|---|---|
| Polymer | Sea | — | Copolymerized PET1 | Copolymerized PET1 | Copolymerized PET1 | Copolymerized PET1 | Copolymerized PET1 | Copolymerized PET1 |
| | Island | — | PET1 | PET1 | PET1 | N6 | N6 | N6 |
| Sea island ratio | Sea | % | 10 | 30 | 90 | 10 | 30 | 90 |
| | Island | % | 90 | 70 | 10 | 90 | 70 | 10 |
| Nozzle | Number of islands | Island/G | 150 | 150 | 150 | 500 | 500 | 500 |
| | G number | — | 110 | 110 | 110 | 100 | 100 | 100 |
| Island-in-a-sea composite fiber | Fineness | dtex | 50 | 50 | 50 | 217 | 217 | 217 |
| | Tensile strength | cN/dtex | 3.0 | 2.5 | 2.1 | 3.5 | 3.0 | 2.3 |
| | Tensile elongation | % | 32 | 35 | 22 | 34 | 31 | 31 |
| Island component | Island component diameter | nm | 500 | 440 | 169 | 600 | 525 | 200 |
| | Variation of the island component diameter | % | 4.2 | 5.0 | 7.5 | 4.5 | 5.5 | 6.5 |
| | Modification ratio | — | 1.02 | 1.04 | 1.08 | 1.05 | 1.03 | 1.02 |
| | Variation of the modification ratio | % | 4.4 | 5.0 | 4.9 | 4.3 | 4.5 | 4.9 |
| | Variation of the distance between the island components | % | 4.5 | 6.2 | 7.1 | 5.1 | 5.4 | 7.5 |
| | Arrangement of the island components | ° | 180 | 180 | 178 | 179 | 179 | 178 |
| Sea component | Variation of the sea component diameter | % | 3.9 | 1.9 | 5.5 | 4.5 | 5.5 | 6.7 |
| | Sea component diameter ratio | — | 0.18 | 0.21 | 0.36 | 0.18 | 0.21 | 0.36 |
| Post-processibility | Loss of the ultrafine fiber | — | A | A | B | A | A | A |
| | Openness of the ultrafine fiber | — | B | B | C | A | A | B |

Examples 17 to 19

The island component used was the N6 (N6 having a melt viscosity of 190 Pa s) used in the Example 14, the sea component was polylactic acid (PLA having a melt viscosity of 100 Pa s). The distribution plate was the one having 500 distribution holes for the island component provided therethrough per ejection hole, and the ejection plate was the one having 200 ejection holes, and the spinning was conducted at a sea/island component composite ratio of 10/90 (Example 17), 30/70 (Example 18), and 90/10 (Example 19), a total through-put rate of 200 g/min, a spinning temperature of 260° C., and a spinning speed of 2000 m/min. The draw ratio was 2.5, and other conditions were the same as those used in the Example 1.

The island-in-a-sea composite fibers collected in Examples 17 to 19 were fibers of 400 dtex—200 filament, and good fiber formation capability was realized even when PLA was used for the sea component since the stress was supported by the substantially evenly and parallelly arranged N6 (island component). In addition, the constitution and consistency of the cross section as well as post-processibility were equivalent to Example 1 even when PLA was used for the island component. The results are shown in Table 4.

TABLE 4

| | | | Example 17 | Example 18 | Example 19 |
|---|---|---|---|---|---|
| Polymer | Sea | — | PLA | PLA | PLA |
| | Island | — | N6 | N6 | N6 |
| Sea island ratio | Sea | % | 10 | 30 | 90 |
| | Island | % | 90 | 70 | 10 |
| Nozzle | Number of islands | Island/G | 500 | 500 | 500 |
| | G number | — | 200 | 200 | 200 |
| Island-in-a-sea composite fiber | Fineness | dtex | 400 | 400 | 400 |
| | Tensile strength | cN/dtex | 4.5 | 3.9 | 2.5 |
| | Tensile elongation | % | 22 | 23 | 20 |
| Island component | Island component diameter | nm | 570 | 510 | 190 |
| | Variation of the island component diameter | % | 4.8 | 5.3 | 6.2 |
| | Modification ratio | — | 1.05 | 1.03 | 1.02 |
| | Variation of the modification ratio | % | 4.3 | 4.9 | 4.9 |
| | Variation of the distance between the island components | % | 5.1 | 5.4 | 6.9 |

TABLE 4-continued

| | | | Example 17 | Example 18 | Example 19 |
|---|---|---|---|---|---|
| | Arrangement of the island components | ° | 178 | 179 | 178 |
| Sea component | Variation of the sea component diameter | % | 4.5 | 5.5 | 6.7 |
| | Sea component diameter ratio | — | 0.13 | 0.22 | 0.74 |
| Post-processibility | Loss of the ultrafine fiber | — | A | A | A |
| | Openness of the ultrafine fiber | — | A | A | B |
| Note | | | | | |

Comparative Example 1

The spinning was conducted by repeating the procedure of Example 1 except that the composite nozzle used was a known pipe-type island-in-a-sea composite nozzle (number of the islands per ejection hole, 1000) described in Japanese Patent Application Laid-Open No. 2001-192924. The spinning could be conducted without trouble. However, fiber breakage due to the inconsistent cross section occurred in 2 spindles in the 4.5 hour sampling.

The evaluation results of the island-in-a-sea composite fiber obtained in Comparative Example 1 are as shown in Table 5. However, large scale island fusion occurred and adequate island-in-a-sea cross section was not formed conceivably because of the excessively high island ratio. As a consequence, the island component diameter was large (coarse) and variation was extremely high compared to our island-in-a-sea composite fiber. For reference, the sea removal as in the case of Example 1 was conducted, and with regard to the post-processibility, loss of microfine island component ejection in the sea removal (evaluation of fiber loss, D), and fibers were coarse due to the fusion of the islands, and the fiber openness was also unfavorable (evaluation of fiber openness, D) due to the high sea component ratio which resulted in the retention of the sea component residue between the ultrafine fibers and adhesion of the ultrafine fibers. The results are shown in Table 5.

Comparative Example 2

In view of the results of the Comparative Example 1, conditions capable of avoiding the island fusion in the case of the nozzle described in the Comparative Example 1 were investigated, and the island fusion was substantially suppressed when the composite ratio of the sea/island component was 50/50. Accordingly, the island-in-a-sea composite fiber was conducted by repeating the procedure of Example 1 except that the composite ratio was 50/50.

In the case of Example 1, while the island component was successfully reduced without fusion, the variation of the island component diameter was high because of the inconsistent cross section due to the ejection instability of the island component. In the case of the nozzle used in Comparative Example 2, the nozzle is so constituted to form a core-and-sheath flow and then thinned by the ejection plate to eject the thin flow, and as a consequence, the island component did not form the perfect circle (modification ratio, 1.19).

Because of the modification ratio of the island-in-a-sea composite cross section associated with the turbulence in the ejection as described above, the consistency of the cross section was, despite the substantial formation of the island-in-a-sea cross section, far inferior to our island-in-a-sea composite fiber. In the drawing step, fiber breakage due to the inconsistent cross section occurred at 2 spindles in the 4.5 hour sampling. When this island-in-a-sea composite fiber was subjected to the sea removal treatment, the ultrafine fiber remained substantially unopened (evaluation of fiber openness, D) also partly because of the high sea component ratio, while severe loss of the ultrafine fiber was not observed (evaluation of fiber loss, B)). The results are shown in Table 5.

Comparative Example 3

The procedure of Example 1 was repeated except for the use of the island-in-a-sea composite nozzle described in Japanese Patent Application Laid-Open No. 2007-39858 wherein thinning of the flow path is repeated a plurality of times, and the composite ratio of the sea/island component of 50/50. Comparative Example 3 was conducted by reducing the island ratio to 50% as in the case of Comparative Example 2, since the islands are fused at the composite ratio of 10/90. Thinning of the flow path had to be conducted 4 times to increase the number of islands to the level equal to Example 1 (1000 islands per ejection hole). In the spinning, breakage of the single fiber (flow) occurred once and, in the drawing, fiber breakage occurred at 4 spindles.

The evaluation results of the island-in-a-sea composite fiber obtained in Comparative Example 3 are as shown in Table 5. While the island component diameter of the island component is reduced, the island component near the outer periphery of the cross section of the island-in-a-sea composite fiber was by far deformed from the perfect circle, and the fibers were inferior to those of our island-in-a-sea composite fibers in the variation of the island component diameter and the variation of the modification ratio were in our fibers. With regard to the fiber openness, many bundles were observed partly because of the high sea component ratio (evaluation of the fiber openness, D), and also, loss of ultrafine fiber island component presumably caused by the variation of the island component was observed (evaluation of the fiber loss, D). The results are shown in Table 5.

Comparative Example 4

The procedure of Example 1 was repeated except that the nozzle used was the conventional known pipe-type island-in-a-sea composite nozzle used in Comparative Example 1 (1000 islands per ejection hole), the sea component used was the N6 (having a melt viscosity of 55 Pa s) used in Example 14, the island component used was the PET1 (having a melt viscosity of 155 Pa s) used in Example 1, the composite ratio of the sea/island component was 50/50, the spinning temperature was 285° C., and the draw ratio was 2.3.

In Comparative Example 4, the spinning temperature was too high in relation to the melting point of the N6 (225° C.), and flow of the sea component in the composite flow became instable. Also, most of the island component had randomly deformed cross-sectional morphology while some part of the island component was ultrafine fibers of nano order. Some of the deformed island components were fused and coarse. With regard to the post-processibility, loss of the ultrafine fibers was significant. The results are shown in Table 5.

TABLE 5

| | | | Comparative Example 1 | Comparative Example 2 | Comparative Example 3 | Comparative Example 4 |
|---|---|---|---|---|---|---|
| Polymer | Sea | — | Copolymerized PET1 | Copolymerized PET1 | Copolymerized PET1 | N6 |
| | Island | — | PET1 | PET1 | PET1 | PET1 |
| Sea island ratio | Sea | % | 10 | 50 | 50 | 50 |
| | Island | % | 90 | 50 | 50 | 50 |
| Nozzle | Number of islands | Island/G | 1000 | 1000 | 1000 | 1000 |
| | G number | — | 15 | 15 | 15 | 15 |
| Island-in-a-sea composite fiber | Fineness | dtex | 37.5 | 37.5 | 37.5 | 37.5 |
| | Tensile strength | cN/dtex | 2.7 | 2.5 | 2.6 | 3.3 |
| | Tensile elongation | % | 19 | 22 | 24 | 24 |
| Island component | Island component diameter | nm | 1136 | 482 | 482 | 734 |
| | Variation of the island component diameter | % | 31.0 | 25.0 | 26.0 | 26.0 |
| | Modification ratio | — | 2.31 | 1.19 | 1.14 | 1.21 |
| | Variation of the modification ratio | % | 32.0 | 16.0 | 16.0 | 19.0 |
| | Variation of the distance between the island components | % | 29.0 | 14.5 | 14.5 | 16.0 |
| | Arrangement of the island components | ° | 154 | 158 | 144 | 158 |
| Sea component | Variation of the sea component diameter | % | 34.0 | 25.0 | 25.0 | 22.0 |
| | Sea component diameter ratio | — | 0.05 | 0.41 | 0.41 | 0.35 |
| Post-processibility | Loss of the ultrafine fiber | — | D | B | D | D |
| | Openness of the ultrafine fiber | — | D | D | D | D |
| Note | | | Island fusion, fiber breakage upon elongation | Fiber breakage upon elongation | Fiber breakage upon elongation | Partial island fusion |

Examples 20 to 22

The procedure of Example 1 was repeated except that the distribution plate had the hole arrangement pattern of FIG. 6(*a*), the distribution plate had 1000 distribution holes for the island component per ejection hole formed therethrough, the ejection plate had 150 ejection holes formed therethrough (with the ejection hole diameter of 0.5 mm (Example 20), 0.3 mm (Example 21), and 0.2 mm (Example 22)), total through-put rate was changed to 20 g/min (Example 20), 10 g/min (Example 21), and 5 g/min (Example 22), the composite ratio of the sea/island components was 50/50, the spinning speed was 3000 m/min, and the draw ratio was 2.5. In the Examples 20 to 22, high fiber formation capability was confirmed due to the consistent cross section and regular arrangement of the island component, and stable spinning at an increased spinning speed of 3000 m/min could be conducted with no fiber breakage. The thus obtained island-in-a-sea composite fiber had consistent cross section despite the extreme fineness of the island component of less than 100 nm. The results are shown in Table 6.

TABLE 6

| | | | Example 20 | Example 21 | Example 22 |
|---|---|---|---|---|---|
| Polymer | Sea | — | Copolymerized PET1 | Copolymerized PET1 | Copolymerized PET1 |
| | Island | — | PET1 | PET1 | PET1 |
| Sea island ratio | Sea | % | 50 | 50 | 50 |
| | Island | % | 50 | 50 | 50 |
| Nozzle | Number of islands | Island/G | 1000 | 1000 | 1000 |
| | G number | — | 150 | 150 | 150 |
| Island-in-a-sea composite fiber | Fineness | dtex | 27.0 | 13.5 | 6.0 |
| | Tensile strength | cN/dtex | 2.5 | 2.0 | 1.7 |
| | Tensile elongation | % | 21 | 19 | 16 |
| Island component | Island component diameter | nm | 90 | 64 | 45 |
| | Variation of the island component diameter | % | 5.0 | 5.0 | 6.7 |
| | Modification ratio | — | 1.01 | 1.02 | 1.03 |
| | Variation of the modification ratio | % | 4.1 | 4.8 | 5.5 |
| | Variation of the distance between the island components | % | 4.4 | 4.5 | 5.7 |
| | Arrangement of the island components | ° | 179 | 179 | 178 |

TABLE 6-continued

| | | | Example 20 | Example 21 | Example 22 |
|---|---|---|---|---|---|
| Sea component | Variation of the sea component diameter | % | 5.4 | 5.1 | 5.9 |
| | Sea component diameter ratio | — | 0.38 | 0.39 | 0.38 |
| Note | | | Spinning speed 3000 m/min | Spinning speed 3000 m/min | Spinning speed 3000 m/min |

Reference Example 23

The procedure of Example 1 was repeated except that the island component was polybuthylene terephthalate (PBT having a melt viscosity of 120 Pa s), the sea component was polylactic acid (PLA having a melt viscosity of 110 Pa s) used in Example 14, and the composite ratio of the sea/island components was 20/80, and the spinning was conducted at the spinning temperature of 255° C. and the spinning speed of 1300 m/min, and draw ratio was 3.2.

In Example 23, the spinning and the elongation could be conducted with no trouble. In addition, the constitution and consistency of the cross section as well as post-processibility were equivalent to Example 1 even when PBT was used for the island component. The results are shown in Table 7.

Reference Example 24

The procedure of Example 1 was repeated except that the island component used was the high molecular weight polyethylene terephthalate (PET2 having a melt viscosity of 240 Pa s) prepared by solid phase polymerization at 220° C. of the PET used in Example 1, the sea component used was polyphenylene sulfide (having a PPS melt viscosity of 180 Pa s), the composite ratio of the sea/island components was 20/80, the spinning was conducted at a temperature of 310° C., and the draw ratio was 3.0.

In Example 24, the spinning and the elongation could be conducted with no trouble. In addition, the constitution and consistency of the cross section as well as post-processibility were equivalent to Example 1 even when PPS was used for the island component. The results are shown in Table 7.

Example 25

The spinning was conducted so that the island component used was the PET2 (having a melt viscosity of 150 Pa s) used in Example 24, the sea component was a liquid crystal polyester (LCP having a melt viscosity of 20 Pa s), the composite ratio of the sea/island component was 20/80, and the spinning temperature was 340° C. In Example 25, the spinning and the elongation could be conducted with no trouble. In addition, the constitution and consistency of the cross section as well as post-processibility were equivalent to Example 1 even when LCP was used for the island component. The results are shown in Table 7.

TABLE 7

| | | | Example 23 | Example 24 | Example 25 |
|---|---|---|---|---|---|
| Polymer | Sea | — | PLA | PPS | LCP |
| | Island | — | PBT | PET2 | PET2 |
| Sea island ratio | Sea | % | 20 | 80 | 80 |
| | Island | % | 80 | 20 | 20 |
| Nozzle | Number of islands | Island/G | 500 | 500 | 500 |
| | G number | — | 15 | 15 | 15 |
| Island-in-a-sea composite fiber | Fineness | dtex | 54.0 | 50.0 | 100.0 |
| | Tensile strength | cN/dtex | 2.3 | 2.5 | 4.5 |
| | Tensile elongation | % | 25 | 32 | 3 |
| Island component | Island component diameter | nm | 725 | 700 | 980 |
| | Variation of the island component diameter | % | 5.0 | 5.0 | 6.7 |
| | Modification ratio | — | 1.03 | 1.02 | 1.07 |
| | Variation of the modification ratio | % | 3.3 | 3.6 | 4.5 |
| | Variation of the distance between the island components | % | 4.4 | 4.5 | 7.7 |
| | Arrangement of the island components | ° | 179 | 179 | 178 |
| Sea component | Variation of the sea component diameter | % | 4.4 | 4.4 | 6.9 |
| | Sea component diameter ratio | — | 0.18 | 0.18 | 0.18 |
| Note | | | | | |

The invention claimed is:

1. An island-in-a-sea composite fiber having a sea/island ratio of 10/90 to 30/70 in a mass ratio, wherein:

a melt viscosity ratio of an island component polymer to a sea component polymer is 1.7 to 7.5, number of island components is of from 2,000 to 10,000, diameter of an island component is 10 to 1000 nm, variation of island component diameter is 1.0 to 7.0%, modification ratio is 1.00 to 1.10, variation of the modification ratio is 1.0 to 10.0%, variation of a diameter of the sea component surrounded by three adjacent island components in the island-in-sea composite cross section is 1.0 to 20.0%, ratio of a sea component diameter to an island component diameter is 0.01 to 1.00, and straight lines each connecting centers of two adjacent island components in a set of four adjacent island components are in parallel relation with each other.

2. The fiber according to claim 1, wherein variation of a distance between 2 adjacent island components is 1.0 to 20.0%.

3. An ultrafine fiber produced by removing the sea component from the island-in-a-sea composite fiber of claim 2.

4. A textile product wherein the island-in-a-sea composite fiber of claim 2 constitutes at least a part of the product.

5. An ultrafine fiber produced by removing the sea component from the island-in-a-sea composite fiber of claim 1.

6. A textile product wherein the ultrafine fiber of claim 5 constitutes at least a part of the product.

7. A textile product wherein the island-in-a-sea composite fiber of claim 1 constitutes at least a part of the product.

* * * * *